US010697692B2

(12) United States Patent
Akalan et al.

(10) Patent No.: US 10,697,692 B2
(45) Date of Patent: Jun. 30, 2020

(54) HOME APPLIANCE DEVICE

(71) Applicant: BSH HAUSGERAETE GMBH, Munich (DE)

(72) Inventors: Yigit Akalan, Tekirdag (TR); Ziya Arslankiray, Tekirdag (TR); Mehmet Ciyanoglu, Istanbul (TR); Lars Dinter, Munich (DE); Emre Emek, Istanbul (TR); Ercan Engin, Tekirdag (TR); Hueseyin Sen, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 449 days.

(21) Appl. No.: 15/363,026

(22) Filed: Nov. 29, 2016

(65) Prior Publication Data

US 2018/0149407 A1 May 31, 2018

(51) Int. Cl.
*F25D 23/02* (2006.01)
*F25D 23/00* (2006.01)

(52) U.S. Cl.
CPC ..... *F25D 23/028* (2013.01); *F25D 23/003* (2013.01); *F25D 23/006* (2013.01); *F25D 2323/0021* (2013.01)

(58) Field of Classification Search
CPC ..... F25D 23/003; F25D 23/028; F25D 23/065
USPC ..... 312/401, 405, 265.5, 265.6; 62/440
See application file for complete search history.

(56) References Cited

U.S. PATENT DOCUMENTS 3,912,349 A * 10/1975 Hoetker ..... F25D 23/00 312/236
4,128,287 A * 12/1978 Loch ..... A47B 95/002 312/140.1
4,932,224 A * 6/1990 Katterhenry ..... F25D 23/00 312/236
4,970,874 A * 11/1990 Solak ..... F25D 23/00 312/116
5,245,841 A * 9/1993 Paul ..... F25C 1/12 312/257.1
5,613,747 A * 3/1997 Becker ..... A47L 15/4265 312/228
6,036,292 A * 3/2000 Mandel ..... A47B 95/002 312/236
2004/0189164 A1* 9/2004 Hwang ..... F25D 23/00 312/405

* cited by examiner

*Primary Examiner* — James O Hansen
(74) *Attorney, Agent, or Firm* — Laurence A. Greenberg; Werner H. Stemer; Ralph E. Locher

(57) ABSTRACT

For the purpose of improving efficiency, a home appliance device, in particular a home chiller appliance device, is proposed. The device includes at least one panel for at least partly covering an opening of a machine compartment; and a connection unit for connecting the panel; the panel comprising at least one panel module which has at least one fin, at least one first fin mounting element and at least one second fin mounting element for mounting the at least one fin, the connection unit comprising at least one connection element for connecting the at least one panel module, and wherein the connection element is movable with respect to the first fin mounting element and the second fin mounting element in a lengthwise direction of the panel in at least one pre-assembled state of the panel.

20 Claims, 13 Drawing Sheets

HOME APPLIANCE DEVICE

BACKGROUND OF THE INVENTION

Field of the Invention

The invention relates to a home appliance device, in particular a home chiller appliance device and a method for assembling a home appliance device.

From the prior art a home appliance device is known which comprises at least one panel for at least partly covering an opening of a machine room.

SUMMARY OF THE INVENTION

An objective of the invention is, in particular, to provide a home appliance device with improved characteristics regarding efficiency. This objective is achieved, according to the claimed invention. Further implementations and further developments of the invention may be gathered from the dependent claims.

A home appliance device, in particular a home chiller appliance device, is proposed, comprising: at least one, preferably at least two and advantageously a plurality of panel/s, for at least partly and preferably at least mostly covering an opening of a machine compartment; and a connection unit for connecting the at least one panel, the panel comprising at least one or at least two or a plurality of panel module/s which has/have at least one or at least two or a plurality of fin/s, at least one first fin mounting element and at least one second fin mounting element for mounting at least one or at least two or a plurality of fin/s, the connection unit comprising at least one connection element for connecting the at least one panel module, the connecting element being movable with respect to the first fin mounting element and the fin second mounting element in a lengthwise direction of the panel in at least one pre-assembled state of the panel.

By means of the invention in particular an efficiency of the home appliance device can be improved. Advantageously, an efficiency of an assembly and/or disassembly can be improved. In particular, an assembly and or disassembly can be carried out toollessly. In particular, a cooling performance can be improved. In addition, a design of the home appliance device may be improved. Preferably by means of the connection unit screws used for assembly may be covered in an efficient manner. In particular, by use of the panel modules the panel may be implemented mirror-invertedly in a simple manner, in particular if an installation side of a home appliance door hinge has to be changed. Furthermore, a stability of the home appliance device may be improved.

In this context, "configured" is in particular to mean specifically programmed, designed and/or equipped. By an object being configured for a certain function is in particular to be understood that the object implements and/or fulfills said certain function in at least one application state and/or operating state. By a "home appliance device" is in particular to be understood at least a portion, preferably a subassembly group, of a home appliance. The home appliance is in particular provided for storing and preferably tempering victuals, such as beverages, meat, fish, vegetables, fruits, milk and/or dairy products, in at least one operating state, advantageously for the purpose of enhancing a keepability of the stored victuals. Advantageously, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven, a steamer and/or a microwave.

In case the home appliance device comprises at least two or a plurality of panels as deemed advantageous by someone skilled in the art, the panels may be embodied at least substantially equivalently or at least substantially differently, as compared to each other. The panel covers at least partly or at least mostly the opening of the machine compartment of the home appliance device, in particular viewed in a direction which is at least substantially perpendicular to a lengthwise direction of the panel. The term "at least mostly" with reference to an object is in particular to mean by more than 50%, preferably more than 65%, further preferably more than 80% and advantageously more than 95% of an object, in particular a surface area and/or a volume and/or a mass of the object. In this context, "at least substantially perpendicular" is in particular to be understood as an orientation of a direction with respect to a reference direction, in particular in a plane, wherein the direction and the reference direction include an angle of 90°, the orientation in particular having a deviation of less than 15°, advantageously of less than 10° and particularly advantageously of less than 2°. The lengthwise direction of the panel is in particular defined by a main extension of the panel. A "main extension" of an object is, in particular, to be understood as a largest extension of an imaginary rectangular cuboid which only just entirely encloses the object and which preferably extends through a geometric center of the object.

In this context, a "machine compartment" is in particular to be understood as a compartment of the home appliance device which is in particular configured for accommodating components, in particular machine components, of the home appliance device. The machine compartment accommodates, in particular at least partly accommodates, a refrigerant cycle of the home appliance device. The refrigerant cycle may comprise in particular a compressor, a condenser, a dryer, an expansion device, an evaporator, a fan unit and/or a heat exchanger, which may at least partly be accommodated inside the machine compartment. The machine compartment may accommodate in particular a door opening unit of the home appliance device, which is configured for opening a home appliance door of the home appliance device. The machine compartment may accommodate in particular a water filter of the home appliance device, which is preferably configured for supplying water. The machine compartment may comprise an opening configured for air circulation, preferably into and/or out of the machine compartment. In particular, in an installation position of the home appliance device, the machine compartment is arranged in a bottom region of the home appliance device. The machine compartment may in particular be different from a storage compartment of the home appliance device, which is configured for storing victuals.

The connection element may in particular be an elongate element. In this context, an "elongate element" is in particular an element having a main extension which is at least three times or at least five times or at least ten times greater than a maximal extension perpendicularly to the main extension. Additionally, the connection unit may comprise an additional connection element, which may in particular be implemented at least substantially equivalently to the connection element. The connection unit may comprise in particular at least one further connection element. The further connection element may in particular be arranged opposite the connection element. A main extension of the connection element and a main extension of the additional connection element, in particular together, are at most equal to and in particular smaller than a main extension of the further connection element. The connection element may connect at least two or a plurality of further panel modules, in particular at least three and for example at least five panel modules of the at least one panel to each other.

The fin may in particular be configured for redirecting air, which is in particular sucked into and/or blown out of the machine compartment, from a direction which is at least substantially perpendicular to the main extension of the fin into a direction which is at least substantially askew with respect to a main extension of the panel. In this context, a direction being "at least substantially askew" is in particular to be understood to differ at least substantially from being parallel and/or from being perpendicular. In this context, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. The fin may comprise in particular at least one angular deflection for deflecting air, which is in particular at least substantially perpendicular to a main extension of the fin. The fin may extend in particular at least substantially parallel to the lengthwise direction of the panel. In particular, at least two fins, which are stacked and spaced apart from one another, embody an air channel. Further the fin may comprise a fixing protrusion and/or a fixing recess which is at least configured for fixing the fin to at least one further component of the panel module. The fin may comprise in particular at least one or at least two or a plurality of blocking recess/es. The blocking recess is may in particular be configured for blocking a movement of the fin with respect to at least one further component of the panel module.

The first fin mounting element and the second fin mounting element may in particular be implemented mirror-invertedly to one another. In the following the first fin mounting element is described in detail. The description regarding the first fin mounting element may be applied to the second fin mount element. The fin mounting elements may be configured for mounting the fins in a form-fit and/or force-fit manner. By the term "in a force-fit and/or form-fit manner" is in particular to be understood connected, preferably releasably connected, wherein a holding force between two structural components is preferably transferred via a geometric engagement of the structural components with each other, and/or preferably via a friction force acting between the structural components. Alternatively or additionally a connection may be provided by substance-to-substance bond, preferably an adhesive and/or cohesive connection. For mounting the at least one fin, the first fin mounting element may comprise in particular at least one mounting profile which is configured for receiving the at least one fin. The mounting profile may correspond in particular to the shape of the at least one fin. In particular, the mounting profile is shaped correspondingly to at least two, in particular a plurality of fins which are stacked and/or spaced apart from each other, in particular in a direction which is at least substantially perpendicular to the lengthwise direction of the panel. The mounting profile may comprise in particular at least one or at least two or a plurality, which is in particular equal to the number of fins, of corresponding angular deflection/s corresponding to the angular deflection of preferably respective at least one or the at least two or the plurality of fins. In particular, the mounting profile may comprise at least one or at least two or a plurality, which is in particular equal to the number of fins, of fixing edge/s corresponding to the fixing edge of the at least one fin. The fin mounting element may be made of plastic.

Further, it is proposed that the connection element and/or the additional connection element may have at least one guiding element, and the first fin mounting element and the second fin mounting element each comprise at least one corresponding guiding element respectively cooperating with the guiding element of the connection unit at least in an assembled state. In particular, the further connection element may have at least one further guiding element, and the first fin mounting element and the second fin mounting element each may comprise at least one further corresponding guiding element respectively cooperating with the further guiding element of the further connection unit at least in an assembled state. In particular, the guiding element of the connection element, the additional connection element and/or the further connection element and the corresponding guiding elements and/or further corresponding guiding elements of the fin mounting elements may be connected to each other in particular in a form-fit and/or force-fit manner. As a result, in particular an assembly of the panel module can be simplified.

In addition, it is proposed that the panel module may comprise at least one or at least two or a plurality of fin reinforcement element/s, which reinforce/s the at least one fin at least in a direction that is perpendicular to the lengthwise direction of the panel, and which is/are respectively connected to at least one of the fin mounting elements by means of the connection unit. For connecting the at least one fin, the fin reinforcement element may comprise in particular at least one reinforcement profile which is configured for receiving the at least one fin. The reinforcement profile corresponds in particular to the shape of the at least one fin. In particular, the mounting profile may be formed correspondingly to at least two, in particular a plurality of fins which are stacked and/or spaced apart from each other preferably in a direction which is at least substantially perpendicular to the lengthwise direction of the panel. The reinforcement profile may comprise in particular at least one or at least two or a plurality, which is in particular equal to the number of fins, of corresponding angular deflection/s, which correspond/s to the angular deflection of preferably the respective at least one, preferably at least two and advantageously the plurality of fins. In particular, the reinforcement profile may comprise at least one or at least two or a plurality, which is in particular equal to the number of fins, fixing edge/s which correspond/s to the fixing edge of the at least one fin. In addition the reinforcement profile may comprise at least one or at least two or a plurality, which is in particular equal to the number of fins, blocking protrusion/s which corresponds to blocking recess/es of the at least one fin. The blocking protrusion and the blocking recess of the fin may cooperate with each other for blocking a movement of the fin with respect to the fin reinforcement element. As a result, a stability of the fins can be improved. In particular, the fins can be implemented in particular as thin fins as they are supported by the fin reinforcement element. The fin reinforcement element may in particular be made of plastic.

For the purpose of connecting the fin reinforcement element in a simple manner, it is proposed that the fin reinforcement element may comprise at least one corresponding guiding element, which cooperates with the guiding element and/or the additional guiding element of the connection unit, in particular of the connection element, at least in an assembled state. In particular, the fin reinforcement element may comprise at least one further corresponding guiding element, which cooperates with the further guiding element of the connection unit, in particular the connection element, at least in an assembled state.

Furthermore, it is proposed that the panel module may comprise at least one air separator, which divides an air flow through the panel and is connected to at least one of the fin mounting elements by means of the connection unit. The air separator may preferably be made of plastic. For connecting the at least one fin, the air separator may comprise in particular at least one separation profile which is configured for receiving the at least one fin. The separation profile may correspond in particular to a shape of the at least one fin. In particular, the separation profile is shaped correspondingly to at least two, in particular a plurality of fins which are stacked and/or spaced apart from each other in particular in a direction which is at least substantially perpendicular to the lengthwise direction of the panel. The separation profile may comprise in particular at least one or at least two or a plurality, which is in particular equal to the number of fins, of corresponding angular deflection/s, which correspond/s to the angular deflection of preferably the respective at least one or the at least two or the plurality of fins. The air separator may comprise in particular at least one corresponding guiding element, which cooperates with the guiding element and/or the additional guiding element of the connection unit, in particular of the connection element, at least in an assembled state. In particular, the air separator may comprise at least one further corresponding guiding element, which cooperates with the further guiding element of the connection unit, in particular of the connection element, at least in an assembled state. It is conceivable that the air separator, the fin reinforcement element and/or the fin mounting element may be implemented integrally with one another. In this context, the term "a first object and a second object being at least partly implemented integrally with one another" is in particular to mean that at least one portion of the first object and at least one portion of the second object are implemented integrally with each other. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. In particular, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank. As a result of this, the air separator can be implemented in the panel.

It is further proposed that, the panel may comprise at least one cover element, which at least partly or at least mostly or entirely covers a machine component and which is connected to at least one of the fin mounting elements by means of the connection unit. The cover element may in particular be embodied as a cover of a door opening unit of the home appliance device. The door opening unit is configured for opening a home appliance door of the home appliance device. The door opening unit may in particular be arranged inside, preferably centrally inside, the machine compartment. The opening device extends in particular at least partly through the cover element. Alternatively or additionally the cover element can be embodied as a hinge cover which at least partly covers a hinge of a home appliance door of the home appliance device and/or which the hinge for the home appliance door is at least partly fixed to. It is conceivable that the cover element is embodied as a water filter cover. The cover element may be made of plastic. The cover element may comprise in particular at least one corresponding guiding element, which cooperates with the guiding element and/or the additional guiding element of the connection unit, in particular of the connection element, at least in an assembled state. In particular, the cover element may comprise at least one further corresponding guiding element, which cooperates with the further guiding element of the connection unit, in particular of the connection element, at least in an assembled state. As a result of this, a uniform design of the panel can be achieved.

In a further implementation of the invention it is proposed that the cover element at least partly or at least mostly or entirely embodies the panel module. Further the cover element could be at least partly implemented integrally with the air separator, the fin reinforcement element and/or the fin mounting element. As a result of this, in particular the cover element may be implemented in the panel in a simple manner.

It is further proposed that the home appliance device may comprise at least one further panel module, which is connected to the panel module by means of the connection unit, in particular by means of the connection element, the additional connection element and/or the further connection element. As a result of this, in particular a plurality of panel modules may be connected to each other in a simple manner.

In a further implementation of the invention it is proposed that the panel may comprise at least one cover element, in particular the aforementioned cover element, which covers at least partly a machine component, which is in particular accommodated inside the machine compartment, and which embodies at least partly the panel module and at least partly the further panel module. In particular, the cover element may at least partly be implemented integrally with at least one fin mounting element of the panel module and at least one fin mounting element of the further panel module. As a result of this, in particular efficiency of the home appliance device, in particular assembly efficiency, can be improved.

In another aspect of the invention, which can in particular be considered in combination with as well as separately from other aspects of the invention, it is proposed that the connection unit is configured for connecting the panel toollessly to a housing of the home appliance device in a form-fit and/or force-fit manner. The connection unit may comprise in particular at least one or at least two or a plurality of interconnection element/s. The interconnection element may preferably be connected to the panel, in particular to a lateral side of the panel and in particular to the fin mounting element and/or the cover element, in particular via a screw fixation. The interconnection element may comprise at least one interconnection guiding element, which is in particular embodied as a pin. The interconnection element may further comprise in particular a preferably deformable snap element, which may be embodied as a snap hook. The interconnection element may in particular be implemented of one piece, e.g. as an injection-molded part. The interconnection element may be made of plastic. The connection unit may comprise in particular a corresponding interconnection element, which in particular cooperates with the interconnection element for interconnecting the panel to the housing. The corresponding interconnection element may in particular be fixed to the housing, in particular via a screw fixation. The corresponding interconnection element may in particular be connected to the housing, in particular to a lateral side of the housing. The corresponding interconnection element may comprise at least one or at least two or a plurality of corresponding interconnection guiding element/s. The corresponding interconnection guiding element may in particular be embodied as a rail. The interconnection element may comprise a corresponding snap element. The corresponding snap element may be embodied as a snap edge. The corresponding interconnection element may comprise in particular a deformation element, which may preferably be embodied as a guiding chamfer. The deformation element may be configured to deform the snap element of the interconnection element. The corresponding interconnection element may in particular be implemented of one piece, in particular as a stamped-and-bent part. The corresponding interconnection element may be made of metal. In particular, in an installed position, the snap element may be snapped into the corresponding snap element and may in particular be deformed by means of the deformation element such that it is wedged behind the corresponding snap element. As a result of this, in particular, the panel can be connected to the housing toollessly.

It is further proposed that the connection unit may comprise a release element, which is accessible through the panel and via which a connection is releasable implemented between the panel and the housing by means of the connection unit. In order to release the interconnection of the interconnection element and the corresponding interconnection element, the release element may be configured to be operated through the panel. When operated the release element may be configured to deform the snap element in order to release it from its wedged position behind the corresponding snap element. As a result of this, in particular a connection between the panel and the housing can be disassembled in a simple manner. The release element may be operatable through a gap between two neighboring fins, in particular from the outside of the home appliance device and/or in particular by using a standard tool such as a screw driver.

In another aspect of the invention, which can in particular be considered in combination with as well as separately from other aspects of the invention, it is proposed that the panel comprises a first panel plane and a second panel plane which are connected to each other by means of the connection unit. In particular the connection unit may comprise at least one adjustment unit for adjusting an offset of the first panel plane with respect to the second panel plane. The first panel plane may in particular be embodied at least partly by at least one or at least two or a plurality of panel modules. Further, the first panel plane may in particular be embodied at least partly by the connection unit, in particular the connection element, the further connection element and the additional connection element. The second panel plane may be embodied by a plate, in particular a metal plate. In particular the first panel plane may be offset with respect to the second panel plane. The connection unit may comprise in particular at least one adjustment unit. The adjustment unit may in particular be configured for adjusting an offset of the first panel plane with respect to the second panel plane. The adjustment unit may comprise at least one adjustment element. The adjustment element may in particular be embodied by the further connection element. The adjustment element may in particular be embodied as a slot. The adjustment unit may comprise at least one engagement element. The engagement element may correspond to the adjustment element and may cooperate with the adjustment element for adjusting the offset. The adjustment element may in particular be embodied by the second panel plane. The engagement element/s may preferably be connected to the guiding element/s by means of a screw connection. As a result of this, a flexibility of the panel can be improved. The panel can in particular be adjusted to different types of furniture housings for an installation of the home appliance device in a home appliance or a kitchen.

In another aspect of the invention, which can in particular be considered in combination with as well as separately from other aspects of the invention, a home appliance device is proposed, in particular a home chiller appliance device, comprising: at least one panel, for at least partly or at least mostly covering an opening of a machine compartment; and a connection unit for connecting the at least one panel, the panel comprising at least two or a plurality of panel modules which have at least one or at least two or a plurality of fin/s, at least one first fin mounting element and at least one second fin mounting element for mounting at least one or at least two or a plurality of fin/s, the connection unit comprising at least one connection element for connecting the at least two panel modules to each other.

A method for assembling a home appliance device comprising at least one pre-assembly step, wherein at least one connection element is moved with respect to at least one first fin mounting element and at least one second fin mounting element in a lengthwise direction of the panel at least for connecting a panel module. By this method, in particular an efficiency of the home appliance device can be improved.

Herein the home appliance device and the method for assembling a home appliance device are not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be respectively transferred to the other specimens of the object accordingly.

DETAILED DESCRIPTION OF THE INVENTION

Figure 1:
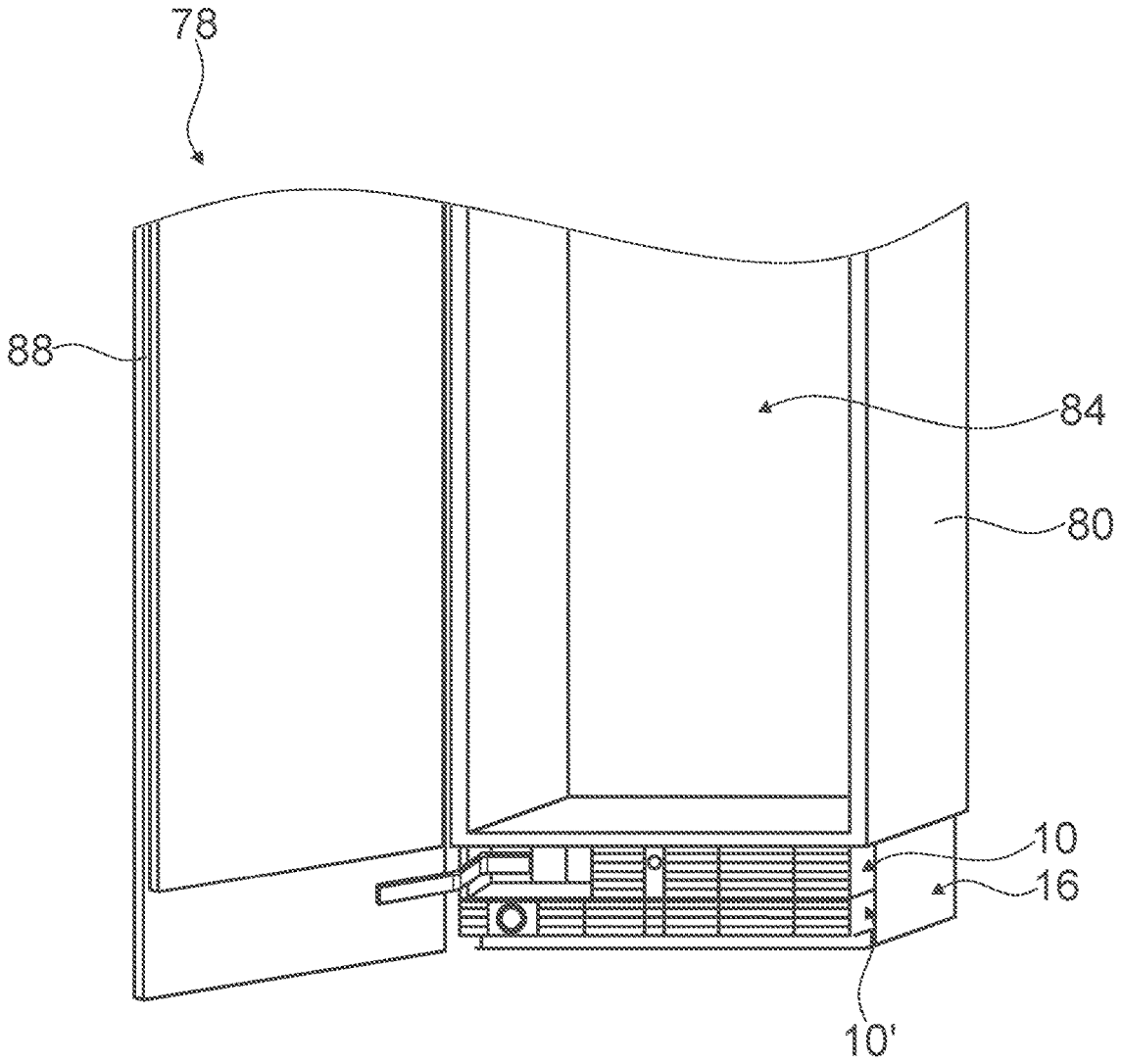
FIG. 1 a home appliance comprising a home appliance device, in a schematic perspective view, FIG. 2 a portion of the home appliance device, comprising a machine compartment, in a cross-sectional top view, FIG. 3 a portion of the home appliance device, comprising a panel and a further panel, in a perspective view, FIGS. 4A, 4B the panel in a pre-assembled state and in a disassembled state, in a perspective view, FIGS. 5A, 5B, 6 a portion of the home appliance device, comprising a connection unit and the panel having a plurality of components, in multiple views, FIGS. 7-10, 11A, 11B, 12A, 12B, 13, 14A, 14B, and 15-17 a portion of the home appliance device, comprising a connection unit and the panel having a plurality of components.

FIG. 1 shows a home appliance 78 comprising a home appliance device, in a schematic perspective view. The home appliance 78 is embodied as a refrigerator. The home appliance 78 could further be embodied as any other home appliance deemed advantageous by someone skilled in the art, e.g. a climate cabinet, an ice-box, a freezer, a wine-cooler and/or a refrigerator-freezer combination.

The home appliance device comprises a housing 80. The housing 80 comprises a storage compartment 84 which is configured for storing victuals. The home appliance device comprises a home appliance door 88. In a closed state, the home appliance door 88 closes the storage compartment 84.

The home appliance device comprises a machine compartment 16. In an installation position of the home appliance device, the machine compartment 16 is arranged at a bottom region of the home appliance device. Inside the machine compartment 16 further components of the home appliance device can be accommodated.

Figure 2:
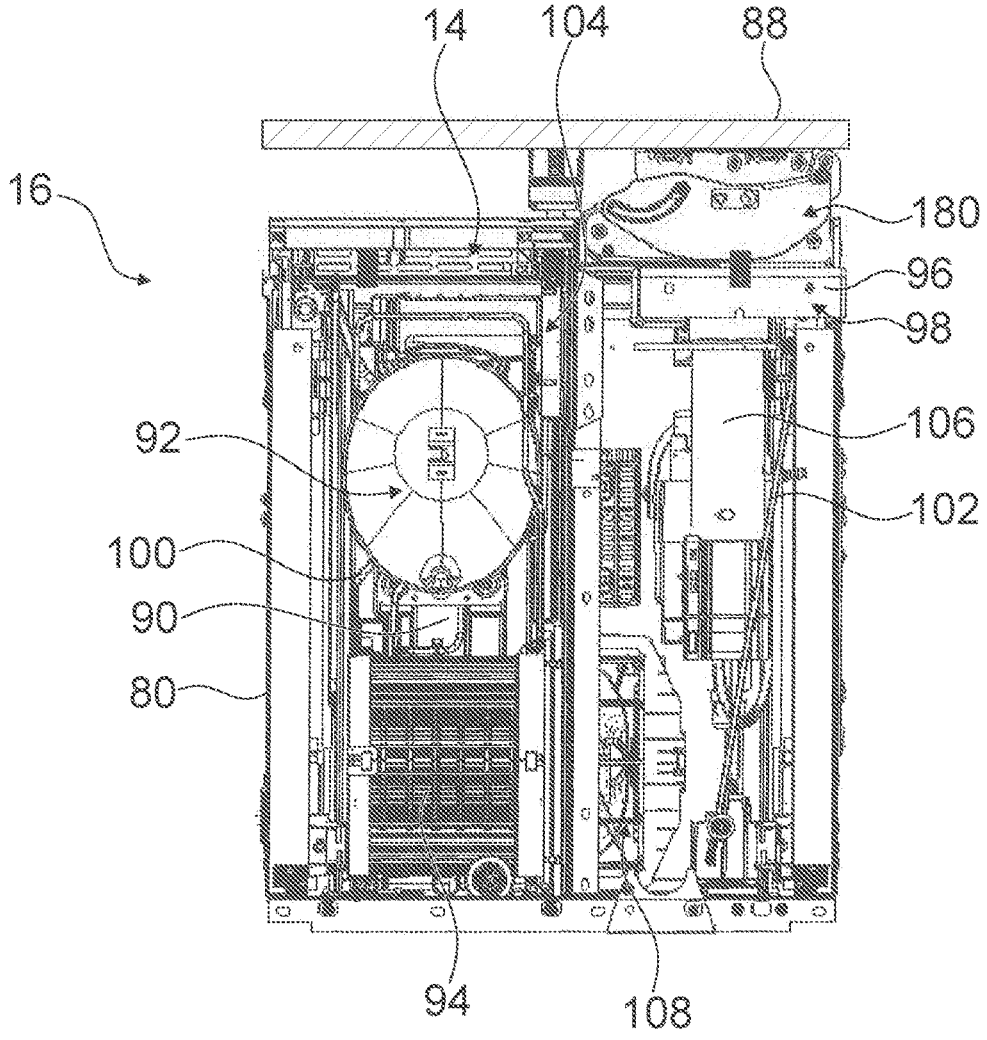

FIG. 2 shows a portion of the machine compartment 16 in a cross-sectional top view. The home appliance device comprises a refrigerant cycle 90. The refrigerant cycle 90 comprises a compressor 92, a condenser 94, a dryer 96, an expansion device 98, an evaporator 100, a fan unit 108 and/or a heat exchanger 102. The machine compartment 16 accommodates at least partly the refrigerant cycle 90, in particular the compressor 92, the condenser 94, the dryer 96, the expansion device 98, the evaporator 100, the fan unit 108 and/or the heat exchanger 102 of the home appliance device. The home appliance device comprises a door opening unit 104. The door opening unit 104 is configured for opening the home appliance door 88. The door opening unit 104 is at least partly accommodated inside the machine compartment 16. The home appliance device further comprises a water filter 106. The water filter 106 is configured for supplying water. The water filter 106 is accommodated inside the machine compartment 16.

The machine compartment 16 comprises an opening 14. In an installation position of the home appliance device, the opening 14 is arranged at a front of the home appliance device, in particular of the machine compartment 16. Through the opening 14 air can be exchanged between an environment of the home appliance device and the machine compartment 16. The air is used by the refrigerant cycle 90 for implementing refrigeration and/or for cooling of machine components inside the machine compartment 16.

Figure 3:
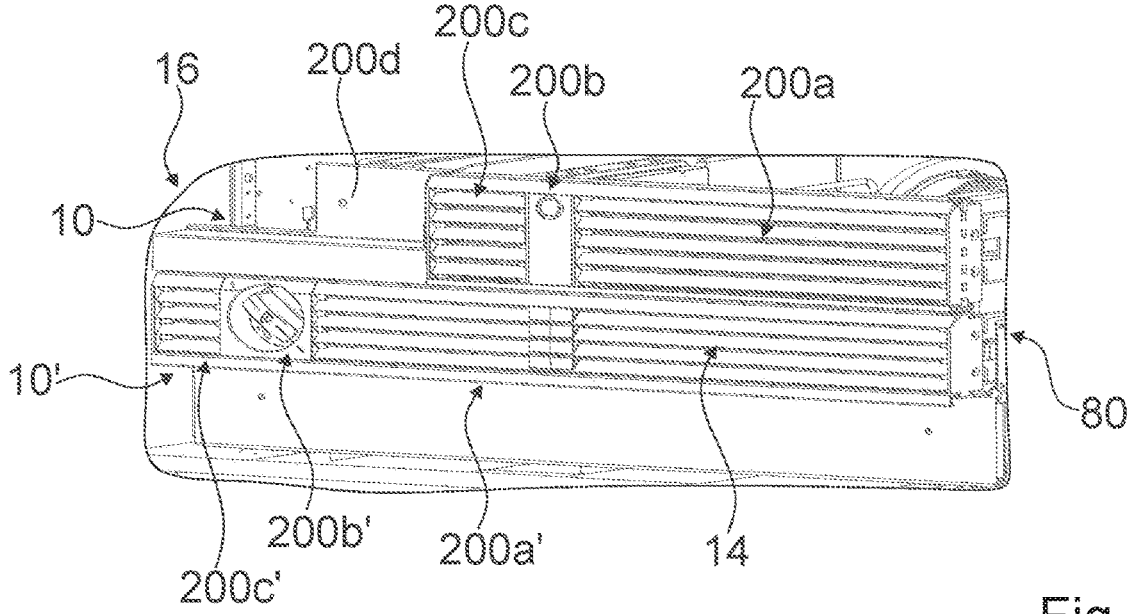

FIG. 3 shows a portion of the home appliance device in a perspective view. The home appliance device comprises at least one panel 10. In the present case the home appliance device comprises only one panel 10. It is conceivable that the home appliance device may comprise a differing number of panels 10 as deemed advantageous by someone skilled in the art.

Figure 4A:
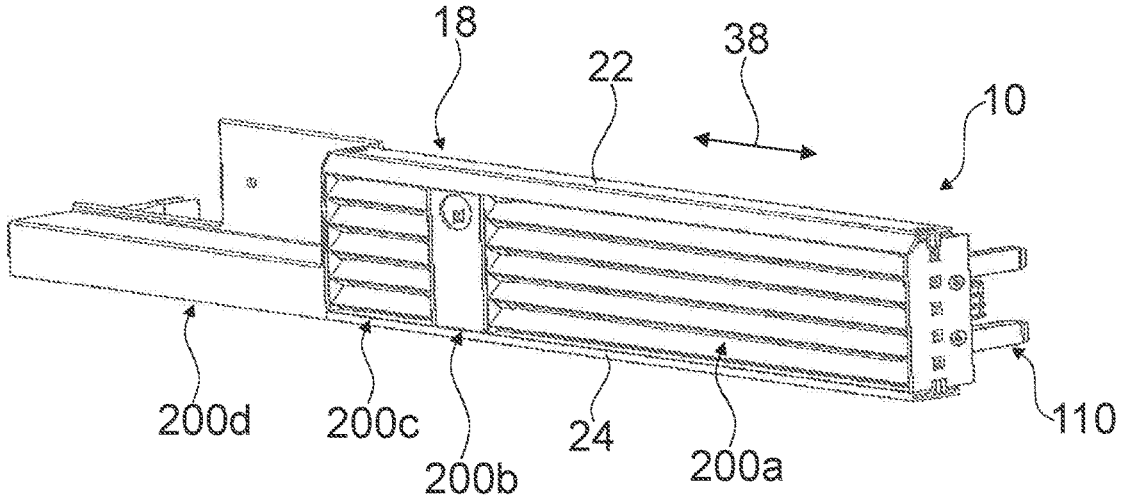
Figure 4B:
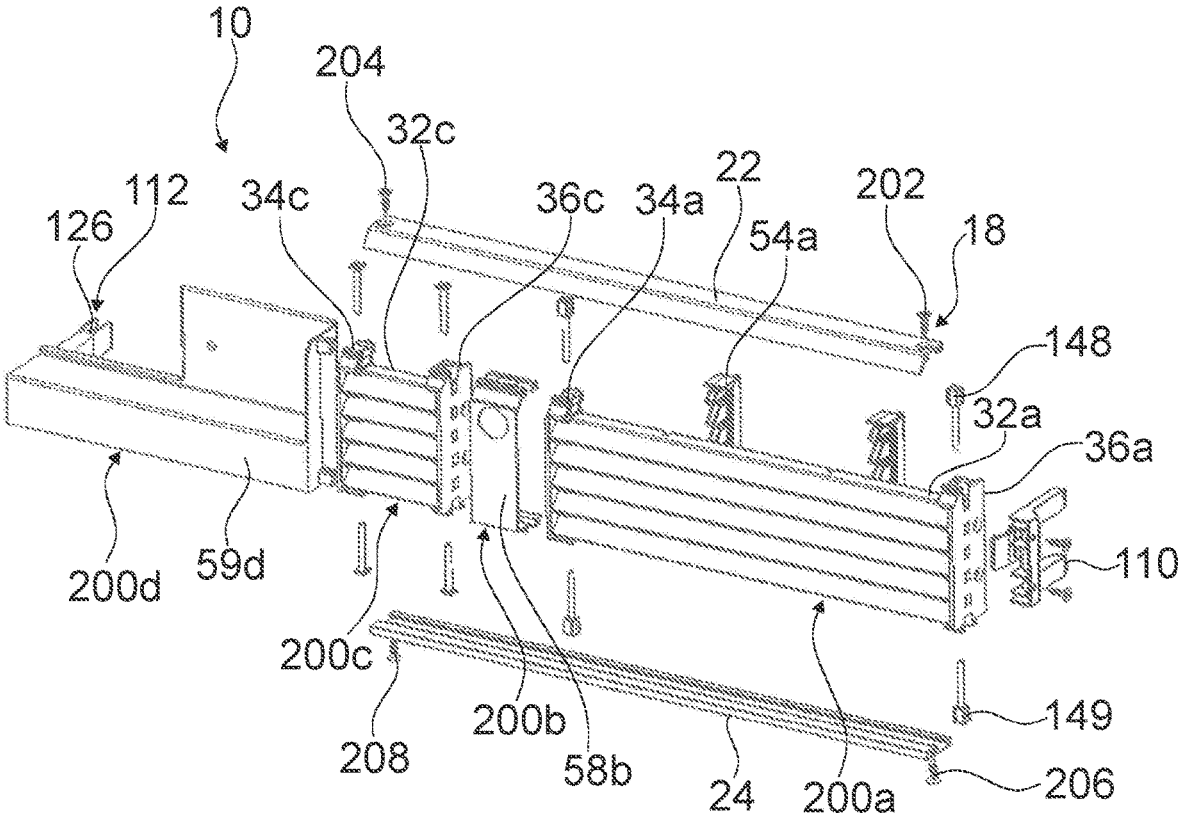

FIGS. 4A and 4B show the panel 10 in a pre-assembled state and in a disassembled state. In the following description and in FIGS. 5 to 17 components of the panel 10, and in particular their interaction with further components of the home appliance device, are described in detail. Further the interaction of the components of the panel 10, in particular regarding an assembly and/or disassembly are described in detail.

The panel 10 at least partly covers the opening 14 of the machine compartment 16 (see FIG. 3). For connecting the panel 10, the home appliance device comprises a connection unit 18. In an installed state, the panel 10 is interconnected with the housing 80 of the home appliance device in a form-fit and/or force-fit manner by means of the connection unit 18. The interconnection of the panel 10 and the housing 80 can be carried out toollessly by means of the connection unit 18.

Figure 5A:
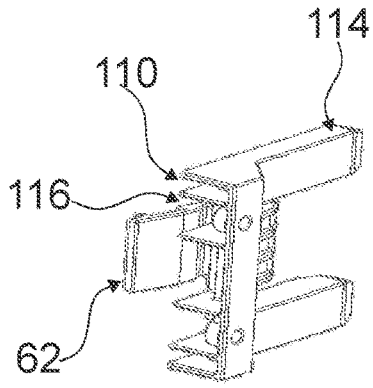
Figure 5B:
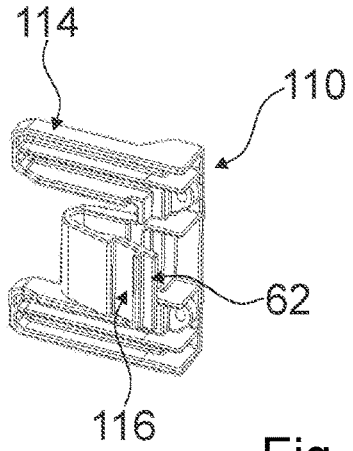

The connection unit 18 comprises at least one interconnection element 110. FIGS. 5A and 5B show the interconnection element 110 from different perspective views. In the present case the connection unit 18 comprises three such interconnection elements 110. It is conceivable that connection unit 18 may comprise a differing number of interconnection elements 110 as deemed advantageous by someone skilled in the art. The following description may be applied to further interconnection elements 110 accordingly.

The interconnection element 110 is connected to the panel 10, in particular via a screw fixation. The interconnection element 110 is fixed to a lateral side of the panel 10. The interconnection element 110 comprises two interconnection guiding elements 114 (see FIGS. 5A and 5B). For the sake of clarity, in the following description and in the drawings only one interconnection guiding element 114 is given a reference numeral and is described in detail. The interconnection guiding element 114 is embodied as a pin. The interconnection element 110 further comprises a snap element 116. The snap element 116 is deformable. The snap element 116 is embodied as a snap hook. The interconnection element 110 comprises a release element 62. The release element 62 is configured for releasing an interconnection, by means of the connection unit 18, between the panel 10 and the housing 80. The release element 62 is accessible through the panel 10. The interconnection element 110 is implemented of one piece. The interconnection element 110 is an injection-molded part. The interconnection element 110 is made of plastic.

Figure 6:
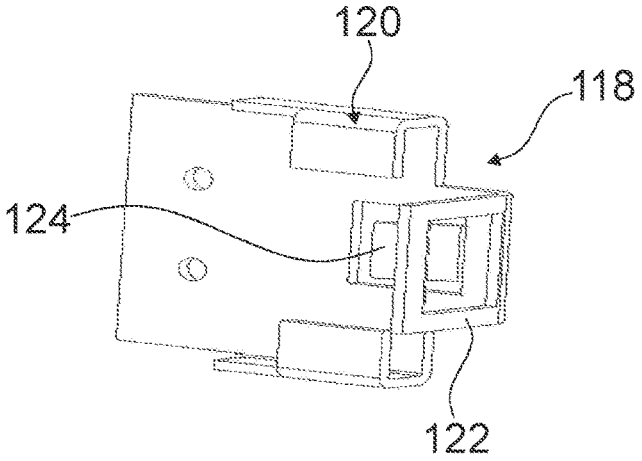

The connection unit 18 comprises a corresponding interconnection element 118 (see FIG. 6). The corresponding interconnection element 118 corresponds to the interconnection element 110. The corresponding interconnection element 118 cooperates with the interconnection element 110 for interconnecting the panel 10 to the housing 80. The corresponding interconnection element 118 is fixed to the housing 80, in particular via a screw fixation. The corresponding interconnection element 118 is connected to the housing 80, in particular to a lateral side of the housing 80. The corresponding interconnection element 118 comprises two corresponding interconnection guiding elements 120. For the sake of clarity, in the following description and in the drawing only one corresponding interconnection guiding element 120 is given a reference numeral and is described in detail. The corresponding interconnection guiding element 120 is embodied as a rail. The interconnection element 118 comprises a corresponding snap element 122. The corresponding snap element 122 is not deformable. The corresponding snap element 122 is embodied as a snap edge. The corresponding interconnection element 118 comprises a deformation element 124. The deformation element 124 is embodied as a guiding chamfer. The corresponding interconnection element 118 is implemented in one piece. The corresponding interconnection element 118 is a stamped-and-bent part. The corresponding interconnection element 118 is made of metal.

Figure 7:
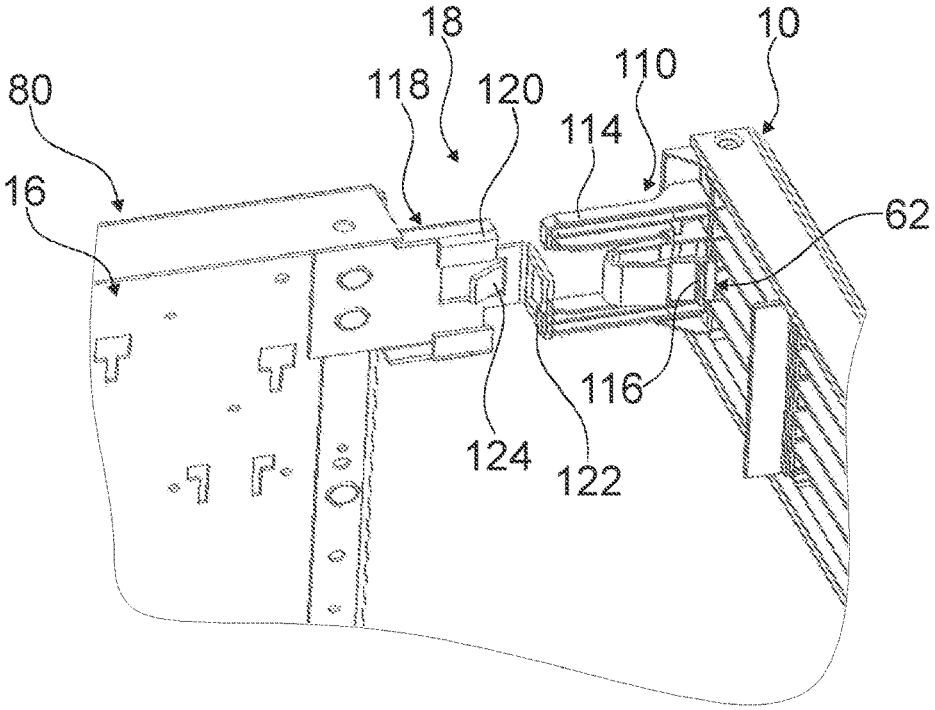

For interconnecting the panel with the housing by means of the connection unit 18, the corresponding interconnection guiding element 118 cooperates with the interconnection guiding element 110 (see FIG. 7). The interconnection element 110 and the corresponding interconnection element 118 are moved towards each other, in particular in a direction that is at least substantially perpendicular to a lengthwise direction 38 of the panel 10. The lengthwise direction 38 is a main extension direction of the panel 10. The interconnection element 110 cooperates with the corresponding interconnection element 118. The interconnection guiding elements 114 engage into the corresponding interconnection guiding elements 120. The snap element 116 snaps into the corresponding snap element 122. The snap element 116 is deformed by the deformation element 124. The snap element 116 is wedged behind the corresponding snap element 122. In order to release the interconnection of the interconnection element 110 and the corresponding interconnection element 118, the release element 62 can be operated through the panel 10. By means of the release element 62 the snap element 116 is released from its wedged position behind the corresponding snap element 122.

Figure 8:
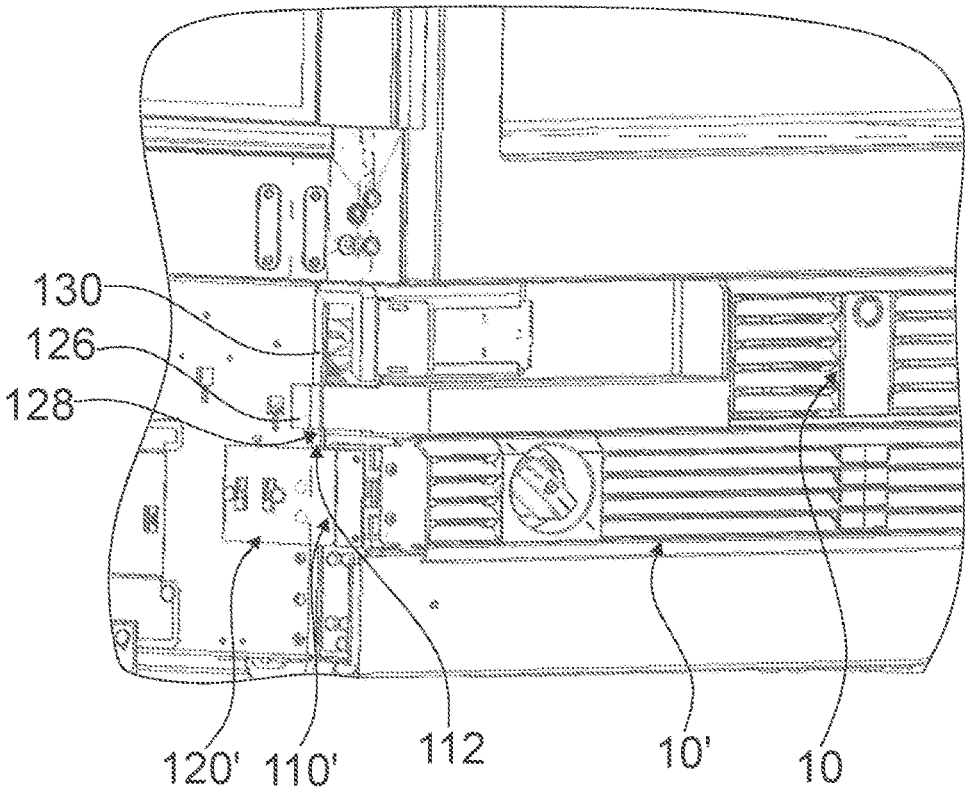

The connection unit 18 comprises a further interconnection element 112 (see FIGS. 4 and 8). The further interconnection element 112 is arranged at a further lateral side of the panel 10, in particular a lateral side which is arranged opposite the interconnection element 110. In the present case the further interconnection element 112 is implemented differently from the interconnection element 110. The further interconnection element 112 comprises a further snap element 126. The further snap element 126 is embodied as a gripper.

The connection unit 18 comprises a further corresponding interconnection element 128. The further corresponding interconnection element 128 is arranged at a further lateral side of the housing 80, in particular an opposite lateral side of the housing, in particular a lateral side which is located opposite the corresponding interconnection element 110. In the present case the further corresponding interconnection element 128 is implemented differently from the corresponding interconnection element 118. The further corresponding interconnection element 128 is implemented integrally with the housing 80. The further corresponding interconnection element 128 comprises a further corresponding snap element 130. The further corresponding snap element 130 is embodied by a bulge of the housing 80.

Further for interconnecting the panel 10 with the housing 80 by means of the connection unit 18, the further corresponding interconnection element 128 cooperates with the further interconnection element 112 for interconnecting the panel 10 with the housing 80. The further interconnection element 112 and the further corresponding interconnection element 128 are moved towards each other, in particular in a direction that is at least substantially perpendicular to the lengthwise direction 38 of the panel 10. The further interconnection element 112 cooperates with the further corresponding interconnection element 128. The further snap element 126 engages around the further corresponding snap element 130. The interconnection of the further interconnection element 110 and the further corresponding interconnection element 118 can be established by manually releasing the interconnection.

The panel 10 comprises at least one panel module 200*a*, 200*b*, 200*c*, 200*d* (see FIGS. 4A and 4B). In the present case the panel 10 comprises four panel modules 200*a*, 200*b*, 200*c*, 200*d*, namely in particular a first panel module 200*a*, a second panel module 200*b*, a third panel module 200*c* and a fourth panel module 200*d*. It is conceivable that the home appliance device may comprise a differing number of panel modules 200*a*, 200*b*, 200*c*, 200*d*, as deemed advantageous by someone skilled in the art.

Figure 9:
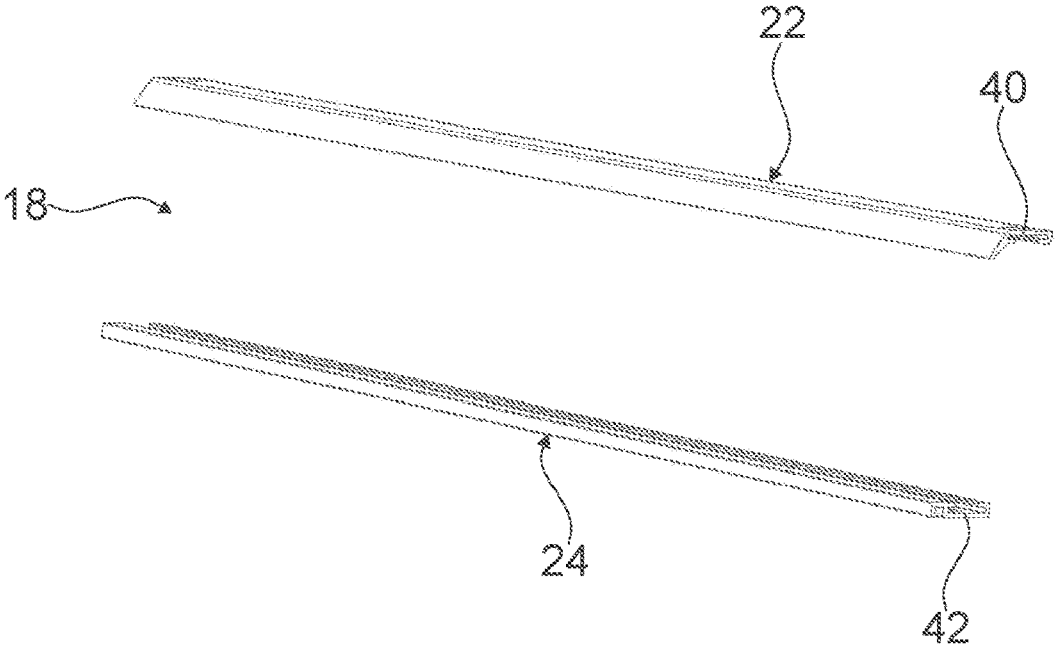

The connection unit 18 comprises at least one connection element 22 (see FIGS. 4A, 4B and 9). The connection element 22 connects at least one panel module 200*a*, 200*b*, 200*c*, 200*d* of the home appliance device. Furthermore, the connection element 22 connects at least two panel modules 200*a*, 200*b*, 200*c*, 200*d* of the panel modules 200*a*, 200*b*, 200*c*, 200*d* to one another. In the present case the connection element 22 connects all of the panel modules 200*a*, 200*b*, 200*c*, 200*d* to each other. It is conceivable that the connection element 22 may connect a differing number of panel modules 200*a*, 200*b*, 200*c*, 200*d* to each other as deemed advantageous by someone skilled in the art. The connection element 22 comprises a guiding element 40, which is configured to cooperate with corresponding guiding elements of components of at least one of the panel modules 200*a*, 200*b*, 200*c*, 200*d*. The connection unit 18 comprises at least one further connection element 24 (see FIGS. 4B and 9). The further connection element 24 connects at least one panel module 200*a*, 200*b*, 200*c*, 200*d* of the home appliance device. Furthermore, the connection element 24 connects at least two panel modules 200*a*, 200*b*, 200*c*, 200*d* of the panel modules 200*a*, 200*b*, 200*c*, 200*d* to one another. In the present case the connection element 24 connects all of the panel modules 200*a*, 200*b*, 200*c*, 200*d* to each other. It is conceivable that the connection element 24 may connect a differing number of panel modules 200*a*, 200*b*, 200*c*, 200*d* to each other as deemed advantageous by someone skilled in the art. The further connection element 24 comprises a guiding element 42, which is configured to cooperate with further corresponding guiding elements of components of at least one of the panel modules 200*a*, 200*b*, 200*c*, 200*d*. The connection unit 18, in particular the connection element 22 and the further connection element 24 are fixed to further components of the home appliance device by means of a screw connection.

Figure 10:
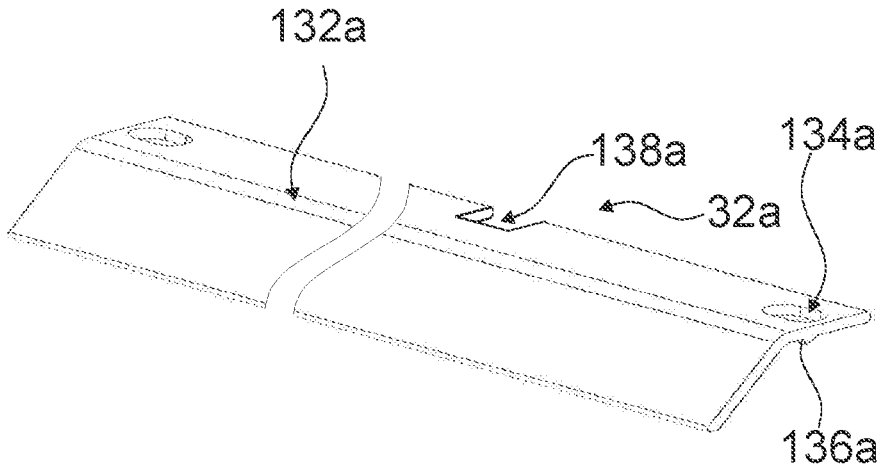

The panel module 200*a* has at least one fin 32*a* (see FIG. 10). In the present case the panel module 200*a* comprises five fins 32*a*. For the sake of clarity, in the following only one fin 32*a* is given a reference numeral and is described in detail. The following description may be applied to further fins 32*a* accordingly. It is conceivable that the panel module 200*a* may comprise a differing number of fins 32*a* as deemed advantageous by someone skilled in the art. The fin 32*a* comprises a main extension which is at least substantially parallel to a main extension of the panel 10. The fin 32*a* is embodied as an elongate sheet.

The fin 32*a* comprises an angular deflection 132*a*. In a pre-assembled state of the panel 10, the angular deflection 132*a* is at least substantially perpendicular to the lengthwise direction 38 of the panel 10.

The fin 32*a* comprises at least one connection recess 134*a*. In the present case the fin 32*a* comprises two connection recesses 134*a*. For the sake of clarity, in the following only one connection recess 134*a* is described in detail. The following description may be applied to the further connection recess 134*a* accordingly. It is conceivable that the fin 32*a* may comprise a differing number of connection recesses 134*a* as deemed advantageous by someone skilled in the art. The connection recess 134*a* is configured for connecting the fin 32*a* to further components of the panel module 200*a*. The connection recess 134*a* is positioned at an end section of the fin 32*a*. The two connection recesses 134*a* are respectively positioned at opposite end sections of the fin 32*a*.

Further the fin 32*a* comprises a fixing edge 136*a*. The fixing edge 136*a* is positioned in a vicinity of the angular deflection 132*a*. The fixing edge 136*a* is configured for fixing the fin 32*a* to further components of the panel module 200*a*. The fixing edge 136*a* extends at least substantially parallel to the lengthwise direction 38*a* of the panel 10.

The fin 32*a* comprises at least one blocking recess 138*a*. It is conceivable that the fin 32*a* may comprise a differing number of blocking recesses 138*a* as deemed advantageous by someone skilled in the art. The following description may be applied to further blocking recesses 138*a* accordingly. The blocking recess 138*a* is configured for blocking a movement of the fin 32*a* with respect to at least one further component of the panel module 200*a*. In particular, the number of blocking recesses 138*a* is equal to the number of fin reinforcement elements 54*a* of the panel module 200*a*.

Figure 11A:
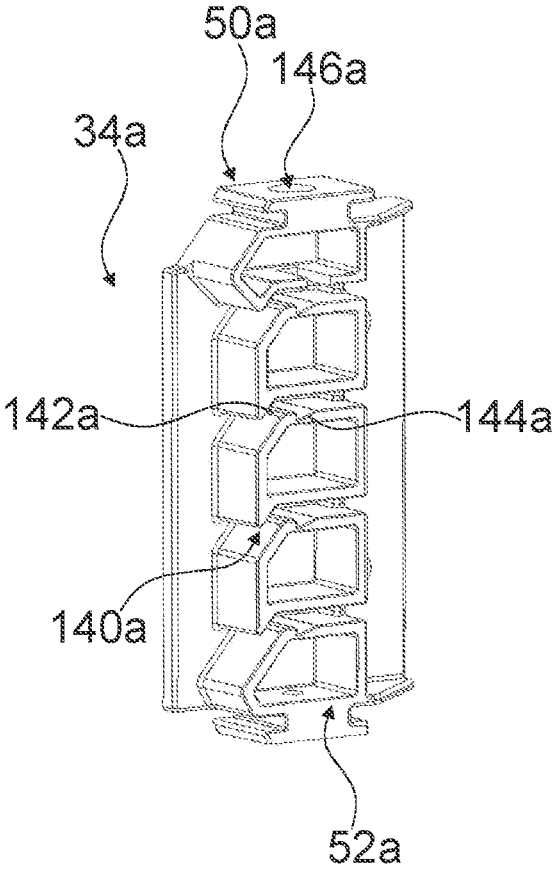
Figure 11B:
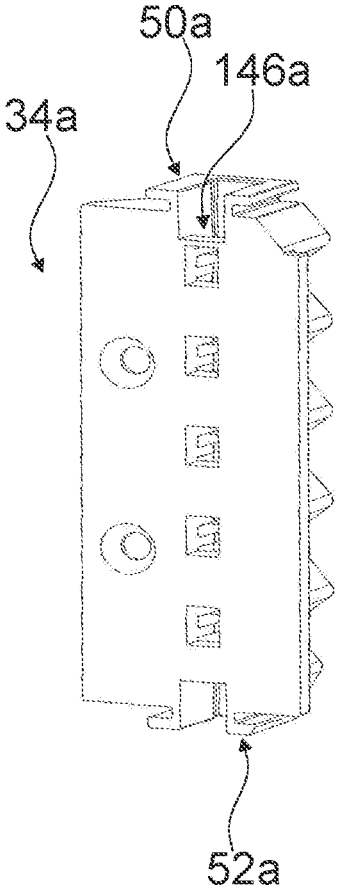

The panel module 200*a* has at least one first fin mounting element 34*a* (see FIGS. 11A and 11B). The panel module 200*a* has at least one second fin mounting element 36*a*. The interconnection element 110 and/or the further interconnection element 112 may be fixed to the first fin mounting element 34*a* and/or the second fin mounting element 36*a*, in particular via a screw connection. In the present case the interconnection element 110 is fixed to the second fin mounting element 36*a*, in particular via a screw connection (see FIGS. 4A, 4B). The fin mounting elements 34*a*, 36*a* are configured for receiving the at least one, in particular five, fin/s 32*a* of the panel module 200*a*. The first fin mounting element 34*a* and the second fin mounting element 36*a* are embodied mirror-invertedly to one another. The fin mounting elements 34*a*, 36*a* each comprise at least one mounting profile 140*a*. The mounting profile 140*a* corresponds to the shape of the at least one fin 32*a*. The mounting profile 140*a* is shaped correspondingly to at least two, preferably five, fins 32*a*, which are stacked and/or spaced apart from each other in a direction which is at least substantially perpendicular to the lengthwise direction 38 of the panel 10. The mounting profile 140*a* comprises at least one corresponding angular deflection 142*a*. The corresponding angular deflection 142*a* corresponds to the angular deflection 132*a* of the at least one fin 32*a*. The mounting profile 140*a* comprises at least one corresponding fixing edge 144*a*. The corresponding fixing edge 144*a* corresponds to the fixing edge 136*a* of the at least one fin 32*a*.

The fin mounting elements 34*a*, 36*a* respectively comprise a connection hole 146*a*. The connection unit 18*a* comprises at least one corresponding connection pin 148*a*. The connection unit 18*a* comprises two corresponding connection pins 148*a*, 149*a* for each connection hole 146*a*. The corresponding connection pins 148*a*, 149*a* correspond to the connection hole 146*a* of the fin mounting elements 34*a*, 36*a* and to the connection recess 134*a* of the fin 32*a*. The connection pins 148*a*, 149*a* cooperate with the connection hole 146*a* of the fin mounting elements 34*a*, 36*a*, and the connection recess 134*a* of the fin 32*a* fixes the fin 32*a* to the fin mounting elements 34*a*, 36*a*, in particular in a form-fit and/or force-fit manner. The connection pin 148*a* is introduced into the connection hole 146*a* from a top side of the fin mounting elements 34*a*, 36*a*. The further connection pin 149*a* is introduced into the connection hole 146*a* from a bottom side of the fin mounting elements 34*a*, 36*a*.

The fin mounting element 34*a* in FIG. 11A is used for the further panel 10' whereas the fin mounting element 34*a* in FIG. 11B is used for the panel 10. Whereas the connection hole 146*a* in FIG. 11B is embodied to be used for the connection pins 148*a*, 149*a* the connection hole 146*a* in FIG. 11A is embodied to be used with a screw. With the screw the connection elements 22, 24 will be fixed to the fin mounting element 34*a* of FIG. 11A.

Figure 18A:
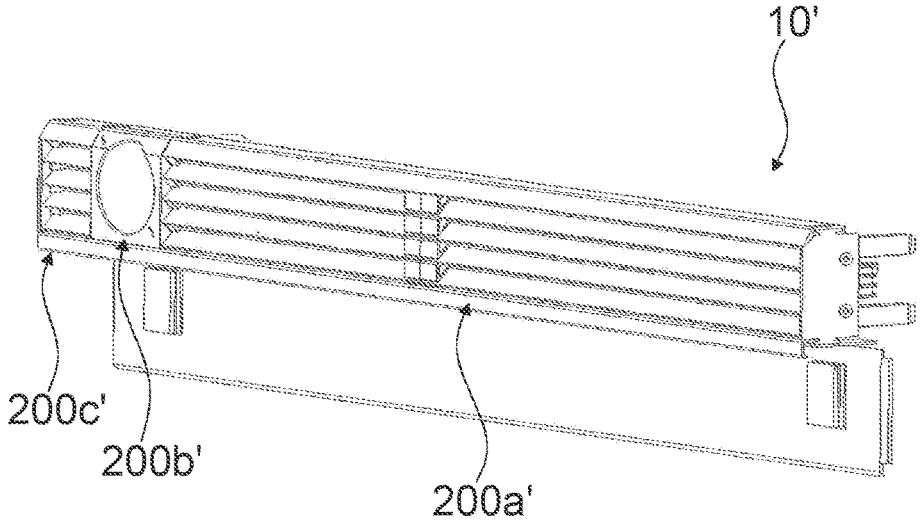
FIGS. 18A, 18B the further panel in a pre-assembled state and in a disassembled state, in a perspective view, and FIGS. 19, 20A, 20B, 21-23, 24A and 24B a portion of the home appliance device, comprising the connection unit and the further panel comprising a plurality of components, in multiple views.
Figure 18B:
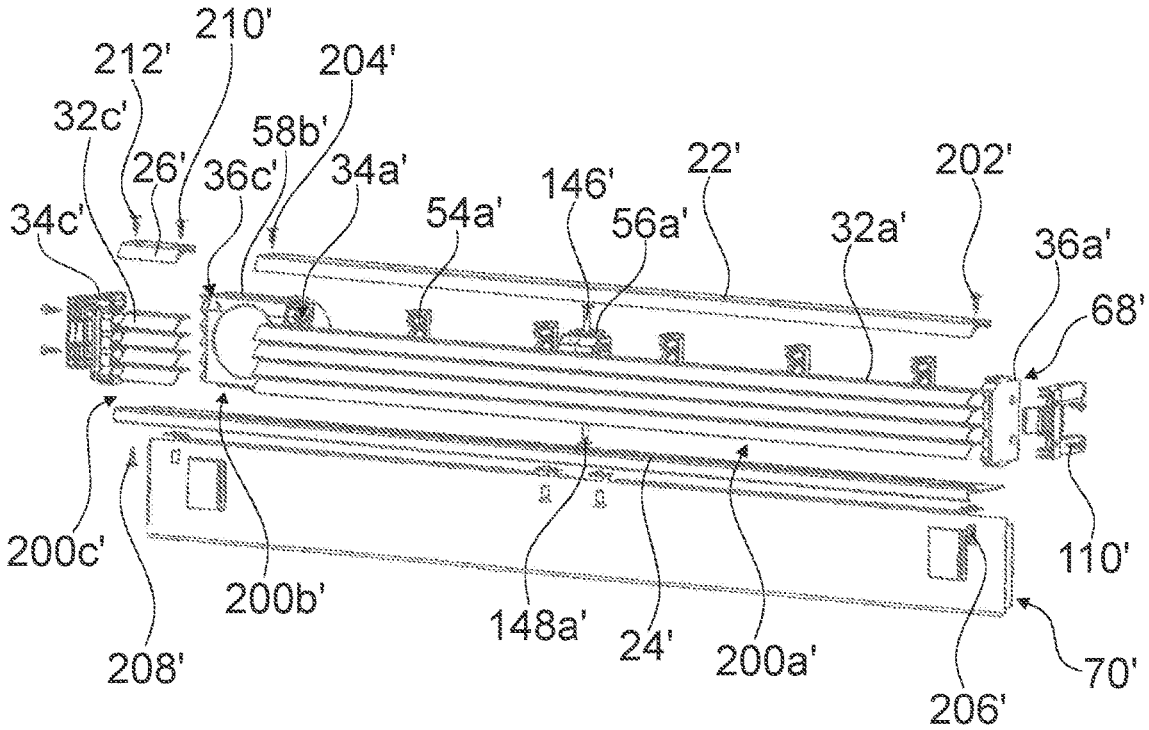

The connection pins 148*a*, 149*a* comprise a pin head and a pin shaft. The pin head is larger in diameter than the pin shaft. The pin head comprises an opening into which screws 202, 204, 206, 208 (FIG. 4B) are screwed. The screws 202, 204, 206, 208 extend also through holes in the connection elements 22, 24. In this way the connection elements 22, 24 are fixed, namely screwed, to the connection pins 148*a*, 149*a*. Likewise screws 202', 204', 206', 208', 210', 212' are used to fix the connection elements 22', 24', 26' (FIG. 18B).

Figure 12A:
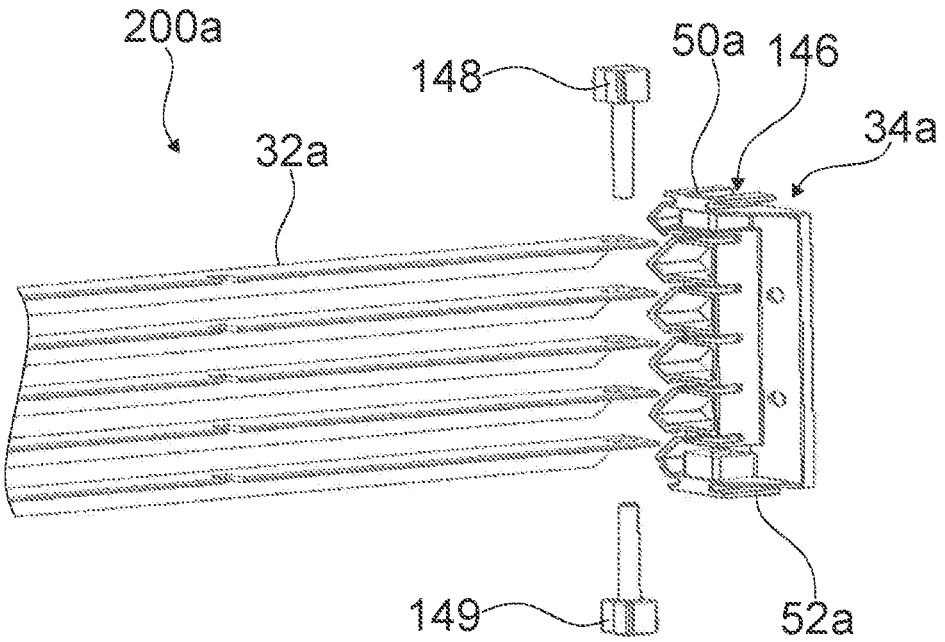
Figure 12B:
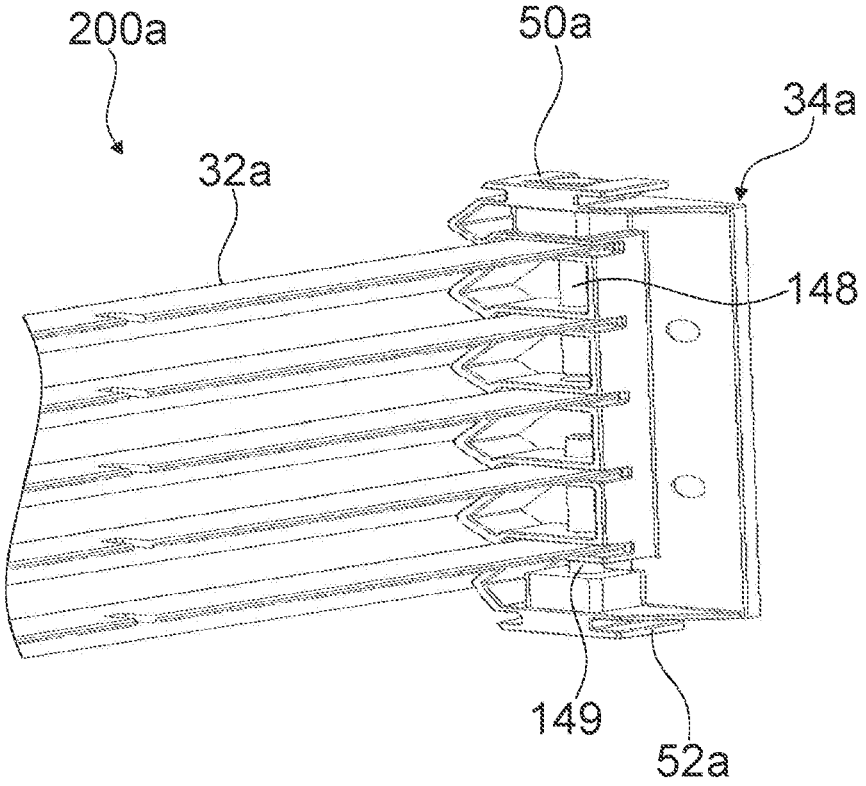

For connecting the fin 32*a* to the fin mounting elements 34*a*, 36*a*, the fin 32*a* is received by the mounting profile 140*a* (see FIGS. 12A and 12B). By means of the mounting profile 140*a*, the fin 32*a* is mounted to the first fin mounting element 34*a*, in particular in a form-fit manner. When mounting the fin 32*a*, the corresponding angular deflection 142*a* of the mounting profile 140*a* cooperates with the angular deflection 132*a* of the at least one fin 32*a*. When mounting the fin 32*a*, the corresponding fixing edge 144*a* of the mounting profile 140*a* cooperates with the fixing edge 136*a* of the at least one fin 32*a*. The fin mounting elements 34*a*, 36*a* each comprise a connection hole 146*a*. The connection hole 146*a* of the first mounting element 34*a* and the connection recess 134*a* are positioned congruently one above the other one. The connection pin 148*a* is pushed into the connection recess 134*a* and the connection hole 146*a* and connects the fin 32*a* to the fin mounting element 34*a*, 36*a*.

In at least one pre-assembled state the connection element 22 is movable with respect to the first fin mounting element 34*a* (see FIGS. 4A and 4B). In at least one pre-assembled state, the connection element 22 is movable with respect to the second fin mounting element 36*a*. The connection element 22 is movable along the lengthwise direction 38 of the panel 10 in at least one pre-assembled state. In at least one pre-assembled state, the further connection element 24*a* is movable with respect to the first fin mounting element 34*a*. In at least one pre-assembled state, the further connection element 24*a* is movable with respect to the second fin mounting element 36*a*. The further connection element 24*a* is movable in the lengthwise direction 38 of the panel 10 in at least one pre-assembled state.

The first fin mounting element 34*a* comprises a corresponding guiding element 50*a* (see FIGS. 11A and 11B). The corresponding guiding element 50*a* of the fin mounting element 34*a* corresponds to the guiding element 40*a* of the connection element 22. For connecting the fin mounting elements 34*a*, 36*a* to each other, the corresponding guiding element 50*a* of the fin mounting element 34*a* cooperates with the guiding element 40*a* of the connection element 22. The fin mounting element 34*a* comprises a further corresponding guiding element 52*a*. The further corresponding guiding element 52*a* of the fin mounting element 34*a* corresponds to the further guiding element 42*a* of the further connection element 24*a*.

For connecting the fin mounting elements 34*a*, 36*a* to each other, the corresponding guiding element 52*a* of the fin mounting element 34*a* cooperates with the further guiding element 42*a* of the further connection element 24*a* (see FIGS. 12A and 12B). When the corresponding connection pins 148*a*, 149*a* are introduced into the connection hole 146*a*, they are flush with the corresponding guiding element 50*a* and the further corresponding guiding element 52*a*. When the corresponding connection pins 148*a*, 149*a* are introduced into the connection hole 146*a*, they are fixed by means of the guiding element 40*a* and the further corresponding guiding element 52*a* of the connection unit 18.

Figure 13:
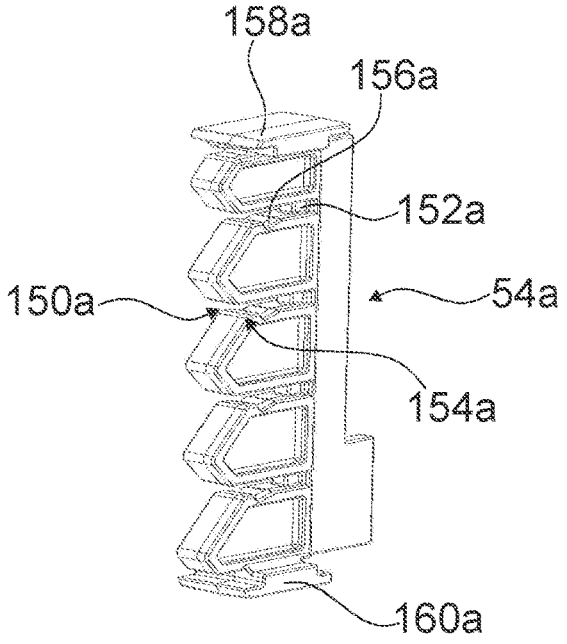

The panel module 200*a* comprises at least one fin reinforcement element 54*a* (see FIG. 13). In the present case the panel module 200*a* comprises two fin reinforcement elements 54*a*. For the sake of clarity, in the following only one fin reinforcement element 54*a* is given a reference numeral and is described in detail. The following description may be applied to further fin reinforcement elements 54*a* accordingly. It is conceivable that the panel module 200*a* may comprise a differing number of fin reinforcement element 54*a* as deemed advantageous by someone skilled in the art. The fin reinforcement element 54*a* reinforces the fin 32*a* at least in a direction perpendicular to the lengthwise direction 38*a* of the panel 10*a*. The fin reinforcement element 54*a* comprises a reinforcement profile 150*a*. The reinforcement profile 150*a* is shaped at least substantially equivalently to the mounting profile 140*a*. The description regarding the mounting profile 140*a*, in particular of the elements of the mounting profile 140*a*, is respectively applicable to the reinforcement profile 150*a*. The reinforcement profile 150*a* corresponds to the shape of the at least one fin 32*a*. The reinforcement profile 150*a* is shaped correspondingly to at least five fins 32*a*, which are stacked and/or spaced apart from each other in a direction which is at least substantially perpendicular to the lengthwise direction 38 of the panel 10. The reinforcement profile 150*a* comprises at least one corresponding angular deflection 154*a*. The corresponding angular deflection 154*a* corresponds to the angular deflection 132*a* of the fin 32*a*. The reinforcement profile 150*a* comprises at least one corresponding fixing edge 156*a*. The corresponding fixing edge 156*a* corresponds to the fixing edge 136*a* of the fin 32*a*. In addition, the reinforcement profile 150*a* comprises a fixing protrusion 152*a*. The fixing protrusion 152*a* corresponds to the blocking recess 138*a* of the fin 32*a*.

Figure 14A:
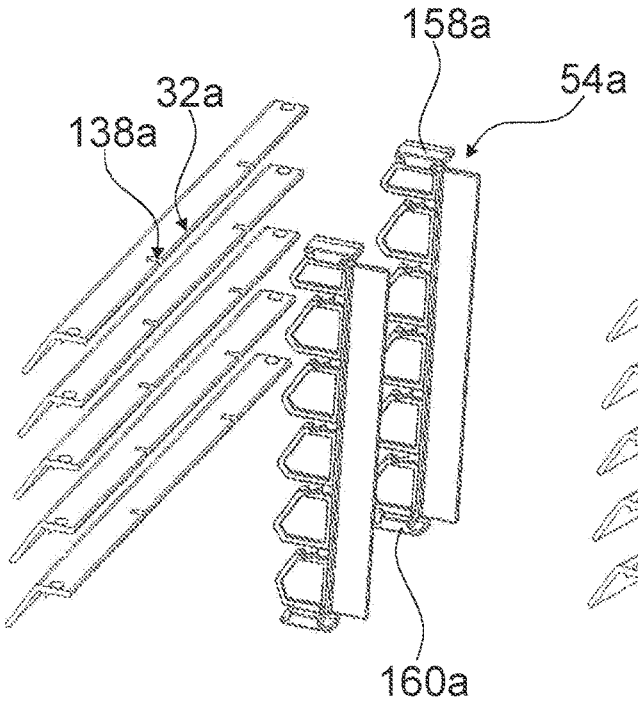
Figure 14B:
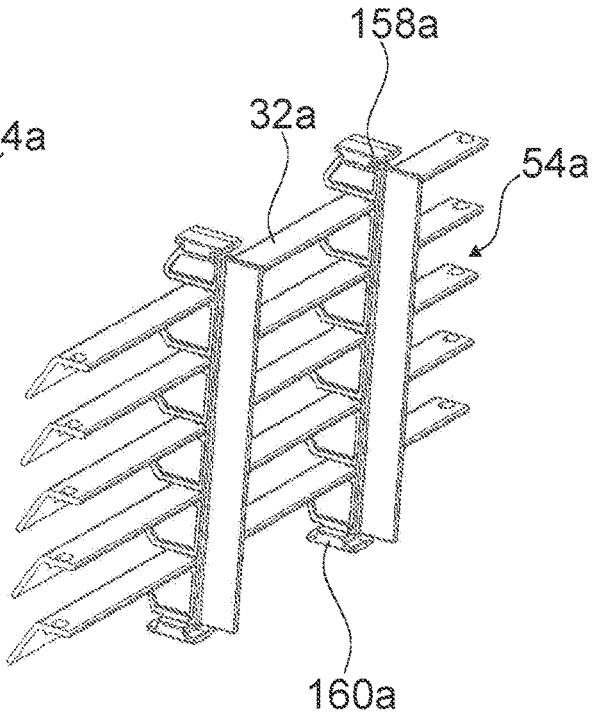
Figure 15:
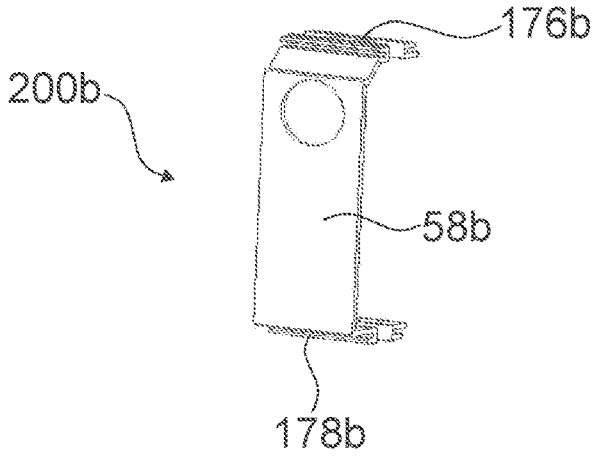

For connecting the fin 32*a* to reinforcement element 54*a*, the fin 32*a* is received by the reinforcement profile 150*a* (see FIGS. 14A and 14B). By means of the reinforcement profile 150*a*, the fin 32*a* is connected to the reinforcement element 54*a*, in particular in a form-fit manner. When connecting the fin 32*a*, the corresponding angular deflection 154*a* of the reinforcement profile 150*a* cooperates with the angular deflection 132*a* of the at least one fin 32*a*. When connecting the fin 32*a*, the corresponding fixing edge 144*a* of the reinforcement profile 150*a* cooperates with the fixing edge 136*a* of the at least one fin 32*a*.

The fin reinforcement element 54*a* is connected to at least to one of the fin mounting elements 34*a*, 36*a* by means of the connection unit 18 (see FIGS. 4A and 4B). The fin reinforcement element 54*a* comprises a corresponding guiding element 158*a* (see FIG. 13). The corresponding guiding element 158*a* of the fin reinforcement element 54*a* corresponds to the guiding element 40 of the connection element 22. The corresponding guiding element 158*a* of the fin reinforcement element 54*a* cooperates with the guiding element 40 of the connection element 22 for connecting the fin reinforcement element 54*a* to at least one fin mounting element 34*a*, 36*a*. The fin reinforcement element 54*a* comprises a further corresponding guiding element 160*a*. The further corresponding guiding element 160*a* of the fin reinforcement element 54*a* corresponds to the further guiding element 42 of the further connection element 24. The further corresponding guiding element 160*a* of the fin reinforcement element 54*a* cooperates with the further guiding element 42 of the further connection element 24 for connecting the fin reinforcement element 54*a* to at least one fin mounting element 34*a*, 36*a*.

The following description of the further panel modules 200*b*, 200*c*, 200*d* is substantially limited to the differences of the panel modules, wherein regarding structural elements, features and functions that remain the same the description of the panel module 200*a* may be referred to. For distinguishing the implementations, the letter a of the reference numerals in the embodiment of the panel module 200*a* has been substituted by the letters b, c and d for the respective panel modules 200*b*, 200*c* and 200*d* of the panel 10. Regarding structural elements having the same denomination, in particular regarding structural elements having the same reference numerals, principally the drawing and/or the description of the embodiment regarding panel module 200*a* may be referred to.

The panel module 200*b* differs from the preceding implementation of the panel module 200*a* at least by a cover element 58*b*. The panel module 200*b* comprises a cover element 58*b* (see FIG. 15). In the present case the cover element 58*b* is a door assistance cover element. Alternatively or additionally the cover element 58*b* may be embodied as a cover for any other component of the machine compartment 16 as deemed advantageous by someone skilled in the art. The cover element 58*b* covers the door opening unit 104 at least partly. In the present case the cover element 58*b* entirely embodies the panel module 200*b*. It is also conceivable that the cover element 58*b* embodies at least partly the panel module 200*b* and at least partly the further panel modules 200*a*, 200*c*, 200*d*. The cover element 58*b* is connected to at least one of fin mounting elements 34*a*, 36*a*, 34*c*, 36*c* by means of the connection unit 18. The cover element 58*b* comprises a corresponding guiding element 176*b*. The corresponding guiding element 176*b* of the cover element 58*b* corresponds to the guiding element 40 of the connection element 22. The corresponding guiding element 176*b* of the cover element 58*b* cooperates with the guiding element 40 of the connection element 22 for connecting the cover element 58*b* to at least one fin mounting element 34*a*, 36*a*, 34*c*, 36*c*. The cover element 58*b* comprises a further corresponding guiding element 178*b*. The further corresponding guiding element 178*b* of the cover element 58*b* corresponds to the further guiding element 42 of the further connection element 24. The further corresponding guiding element 178*b* of the cover element 58*b* cooperates with the further guiding element 42 of the connection element 24 for connecting the cover element 58*b* to at least one fin mounting element 34*b*, 36*b*. Alternatively or additionally the cover may be at least partly implemented integrally with at least one fin mounting element 34*a*, 36*a*, 34*c*, 36*c*.

The panel module 200*c* differs from the aforementioned implementation of panel module 200*a* at least substantially by the implementation of at least one fin 32*c* of the panel module 200*c*. In the present case the fin 32*c* is shorter than the fin 32*a*. Further the fin 32*c* does not comprise a blocking recess. Due to the fact that the at least one fin 32 *c* is shorter, fin reinforcement elements such as the fin reinforcement elements 34*a*, 36*a* of the panel module 200*a* can be dispensed with in the case of panel module 200*c*. The fin 32*c* is mounted to a first fin mounting element 34*c* and a second fin mounting element 36*c* of the panel module 200*c*.

Figure 16:
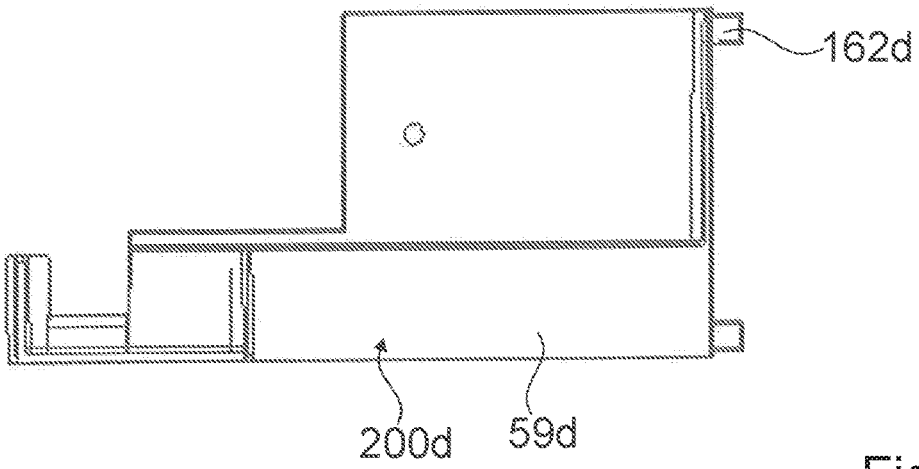
Figure 17:
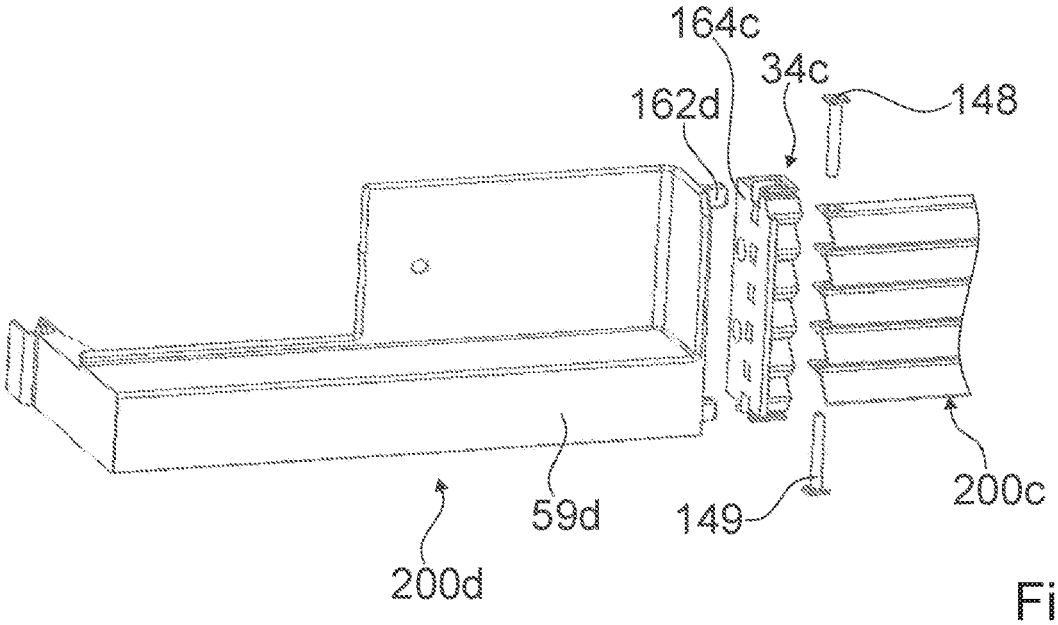

The panel module 200*d* differs from the preceding implementation of the panel module 200*a* at least by a cover element 59*d* (see FIG. 16). The panel module 200*d* comprises the cover element 59*d*. In the present case a further interconnection element 112 is implemented integrally with the cover element 58*d*. Alternatively the further interconnection element 112 of the connection unit 18 may be fixed to the cover element 59*d*, in particular via a screw connection. In the present case the cover element 59*d* is a hinge cover element. Alternatively or additionally the cover element 58*d* may be a cover for any other component of the machine compartment 16 as deemed advantageous by someone skilled in the art. The cover element 59*d* provides an opening for a hinge 180 of the home appliance door 88, which may be fixed to a housing of the home appliance device. The cover element 59*d* entirely embodies the panel module 200*d*. It is also conceivable that the cover element 59*d* embodies at least partly the panel module 200*d* and at least partly the further panel modules 200*a*, 200*b*, 200*c*.

The cover element 59*d* is connected to at least one of the fin mounting elements 34*a*, 36*a* 34*c*, 36*c* by means of the connection unit 18 (see FIGS. 4A, 4B and 7). In the present case the cover element 59*d* is connected to a fin mounting element 34*c*, 36*c* of the panel module 200*c*. The cover element 59*d* comprises at least one protrusion element 162*d*. The protrusion element 162*d* corresponds to a protrusion recess 164*c* of a fin mounting element 34*c*, 36*c* of the panel module 200*c*. Alternatively or additionally the cover element 59*d* may be at least partly implemented integrally with at least one fin mounting element 34*c*, 36*c*. The protrusion element 162*d* comprises an opening for a screw (screw not shown in FIG. 17). After the fins are inserted into the fin mounting element 34*c* and have been fixed via the pins 148, 149, the protrusion element 162*d* is inserted into a reception of the fin mounting element 34*c*. The connection element 22 will be placed on top of the fin mounting element 34*c* and will be fixed via the screw which is screwed into the opening of the protrusion element 162.

In the present case the home appliance device comprises at least one further panel 10'. FIGS. 18A and 18B show the further panel 10' in a pre-assembled state and in a disassembled state. In the following description and FIGS. 18 to 24 components of the further panel 10' and in particular their interaction with further components of the home appliance device are described in detail. Further the interaction of the components of the further panel 10', in particular regarding an assembly and/or disassembly, is described in detail.

The preceding description regarding the panel 10 may be at least partly, in particular entirely be respectively transferred to the further panel 10' accordingly. The panel 10' at least partly covers the opening 14 of the machine compartment 16 (see FIG. 3). The following description of the further panel 10' is substantially limited to the differences of the panels 10 and 10', wherein regarding structural elements, features and functions that remain the same the description of the panel 10 may be referred to. For distinguishing the different implementations, the reference numerals X in the embodiment of the panel 10 have been substituted by respective reference numerals X' for the respective panel 10'. Regarding structural elements having the same denomination, in particular regarding structural elements having the same reference numerals, principally the drawing and/or the description of the implementation of panel 10 may be referred to.

The panel 10' differs from the preceding implementation of the panel 10 at least by a number of panel modules (see FIGS. 18A and 18B). The panel 10' comprises at least one panel module 200*a*', 200*b*', 200*c*'. In the present case the panel 10' comprises three panel modules 200*a*', 200*b*', 200*c*', namely in particular a first panel module 200*a*', a second panel module 200*b*' and a third panel module 200*c*'. It is conceivable that the home appliance device may comprise a differing number of panel modules 200*a*', 200*b*', 200*c*' as deemed advantageous by someone skilled in the art.

Figure 19:
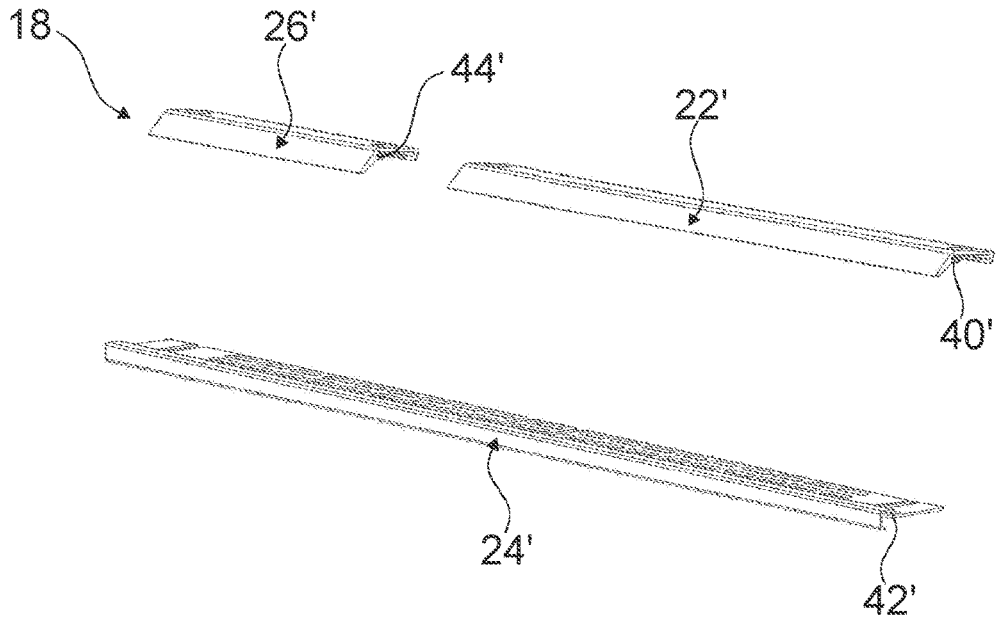

The connection unit 18 comprises at least one connection element 22' (see FIG. 19). The connection element 22' connects at least one of the panel modules 200*a*', 200*b*', 200*c*'. Furthermore, the connection element 22 connects at least two panel modules 200*a*', 200*b*', 200*c*' of the panel modules 200*a*', 200*b*', 200*c*' to one another. In the present case, the connection element 22' connects the panel module 200*a*' and the panel module 200*b*' to each other. The connection element 22' comprises a guiding element 40', which is configured to cooperate with corresponding guiding elements of components of at least one of the panel modules 200*a*', 200*b*', 200*c*'. The connection unit 18 comprises at least one additional connection element 26'. In the present case, the additional connection element 26' connects the panel module 200*b*' and the panel module 200*c*' to each other. The additional connection element 26' comprises a guiding element 44', which is configured to cooperate with the corresponding guiding elements of components of at least one of the panel modules 200*a*', 200*b*', 200*c*'. The connection unit 18 comprises at least one further connection element 24'. In the present case the connection element 24' connects the panel modules 200*a*', 200*b*', 200*c*' to each other. The further connection element 24' comprises a guiding element 42' which is configured to cooperate with further corresponding guiding elements of components of at least one of the panel modules 200*a*, 200*b*, 200*c*, 200*d*. In the present case, at least the connection element 22' and/or the additional connection element 26' is embodied differently from the connection element 22. A length of the connection element 22' and/or a length of the additional connection element 26' is shorter than the length of the further connection element 24'. The connection unit 18', in particular the connection elements 22', 24', 26' are fixed to further components of the home appliance device by means of a screw connection.

The panel module 200*a*' has at least one fin 32*a*'. In the present case the first module comprises four such fins 32*a*'. The fin 32*a*' comprises at least one connection recess 134*a*'. In the present case the fin 32*a*' comprises three connection recesses 134*a*'. The two connection recesses 134*a*' are positioned at opposite ending section of the fin 32*a*'. At least one of the connection recesses 134*a*' is/are positioned between an end section, in particular in a center of the fin 32*a*'.

Figure 20A:
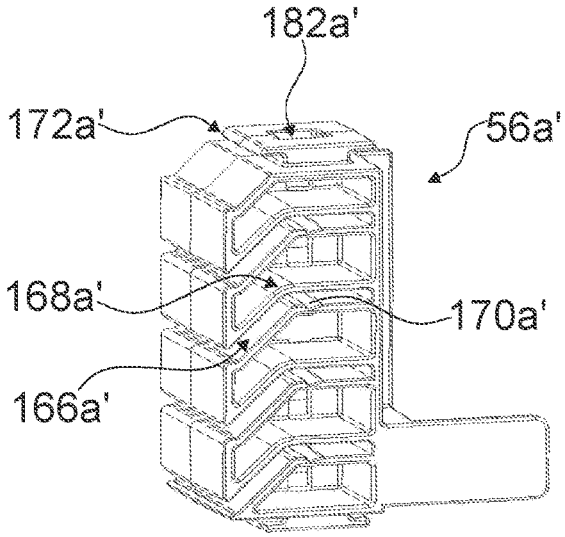
Figure 20B:
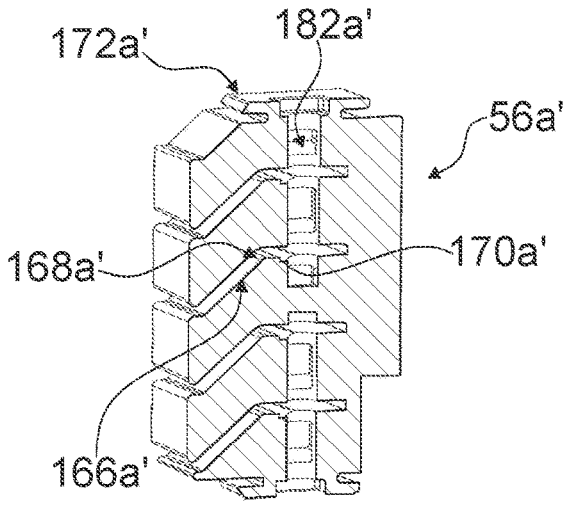
Figure 21:
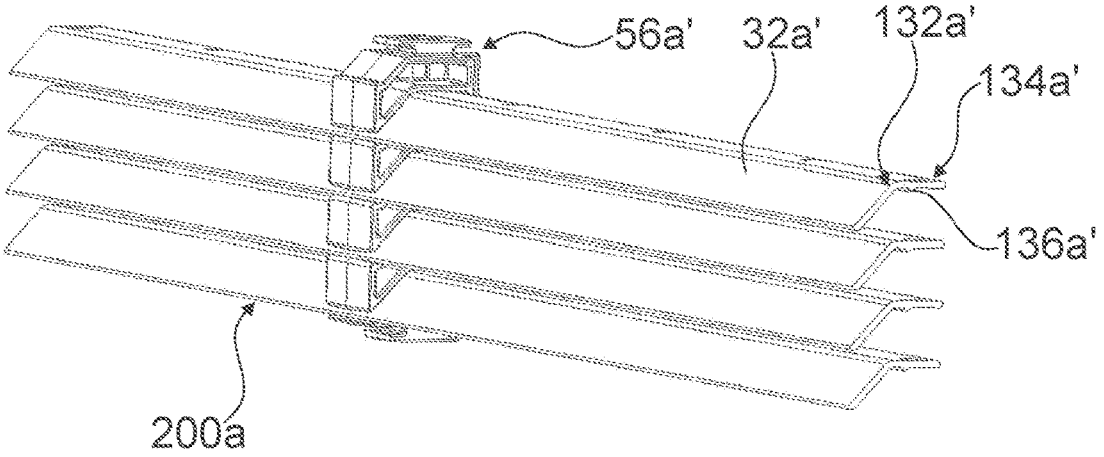

In an additional or alternative implementation of the panel module 200*a*, the panel module 200*a*' comprises at least one air separator 56*a*' (see FIGS. 20A, 20B and 21). The air separator 56*a*' separates an air flow through the panel 10'. The air separator 56*a*' comprises a separation profile 166*a*'. The separation profile 166*a*' is shaped at least substantially equivalently to the mounting profile 140*a*. The description regarding the mounting profile 140*a*, in particular of the elements of the mounting profile 140*a*, preferably the corresponding fixing edge 144*a*, is applicable to the separation profile 166*a*'. The shape of the separation profile 166*a*' corresponds to the shape of the at least one fin 32*a*'. The separation profile 166*a*' is shaped correspondingly to at least four fins 32*a*', which are stacked and/or spaced apart from each other in a direction which is at least substantially perpendicular to a lengthwise direction 38' of the panel 10'. The separation profile 166*a*' comprises at least one corresponding angular deflection 168*a*'. The corresponding angular deflection 168*a*' corresponds to an angular deflection 132*a*' of the at least one fin 32*a*'. The separation profile 166*a*' comprises at least one corresponding fixing edge 170*a*'. The corresponding fixing edge 170*a*' corresponds to a fixing edge 136*a*' of the at least one fin 32*a'*.

The panel module 200*a*' comprises at least one first fin mounting element 34*a*' (see FIGS. 18A and 18B). The panel module 200*a*' comprises at least one second fin mounting element 36*a*'. In the present case of the panel module 200*a*', the connection unit 18 comprises two interconnection elements 110'. The interconnection element 110 is fixed to the second fin mounting element 36*a'*.

The panel module 200*a*' comprises at least one fin reinforcement element 54*a*'. The fin reinforcement element 54*a*' is embodied equivalently to the fin reinforcement element 54*a*. In the present case the panel module 200*a*' comprises five fin reinforcement elements 54*a'*.

For fixing the fin 32*a*' to the air separator 56*a*' the fin 32*a*' is received by the separation profile 166*a*'. By means of the separation profile 166*a*', the fin 32*a*' is fixed to the air separator 56*a*', in particular in a form-fit manner. During fixing of the fin 32*a*' the corresponding angular deflection 168*a*' of separation profile 166*a*' cooperates with an angular deflection 132*a*' of the at least one fin 32'*a*. When fixing the fin 32*a*', the corresponding fixing edge 170*a*' of the separation profile 166*a*' cooperates with the fixing edge 136*a*' of the fin 32*a*'. The separation profile 166*a*' comprise a connection hole 182*a*'. The connection hole 182*a*' of the air separator 56*a*' and the connection recess 134*a*' of the fins 32*a*' are positioned congruently on top of each other. A connection pin 148' is pushed into the connection recess 134*a*' and the connection hole 182*a*', connecting the fin 32*a*' to the air separator 56*a'*.

The air separator 56*a*' is connected to the at least one fin mounting element 32*a*', 34*a*' of the panel module 200*a*' by means of a connection unit 18. The air separator 56*a*' comprises a corresponding guiding element 172*a*'. The corresponding guiding element 172*a*' of the air separator 56*a*' corresponds to the guiding element 40' of the connection element 22'. For connecting the air separator 54*a*' to at least one fin mounting element 34*a*', 36*a*', the corresponding guiding element 172*a*' of the air separator 56*a*' cooperates with the guiding element 40' of the connection element 22'. The air separator 56*a*' comprises a further corresponding guiding element 174*a*'. The further corresponding guiding element 174*a*' of the air separator 56*a*' corresponds to the further guiding element 42' of the further connection element 24'.

Figure 22:
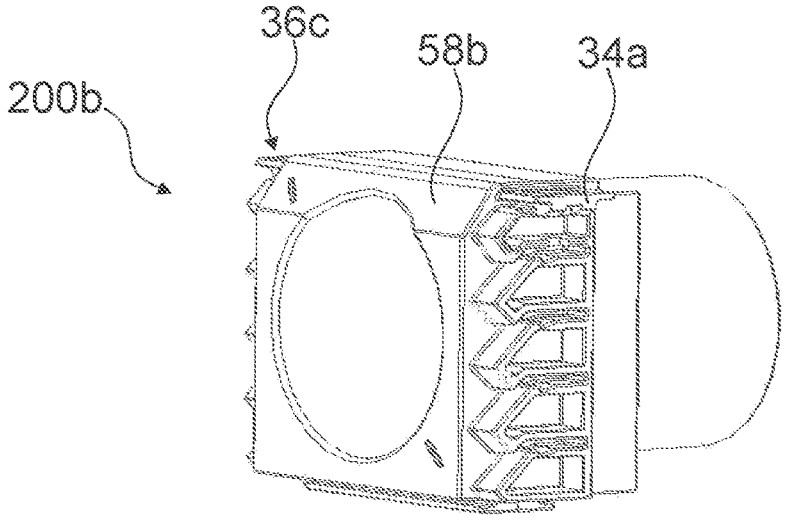
Figure 23:
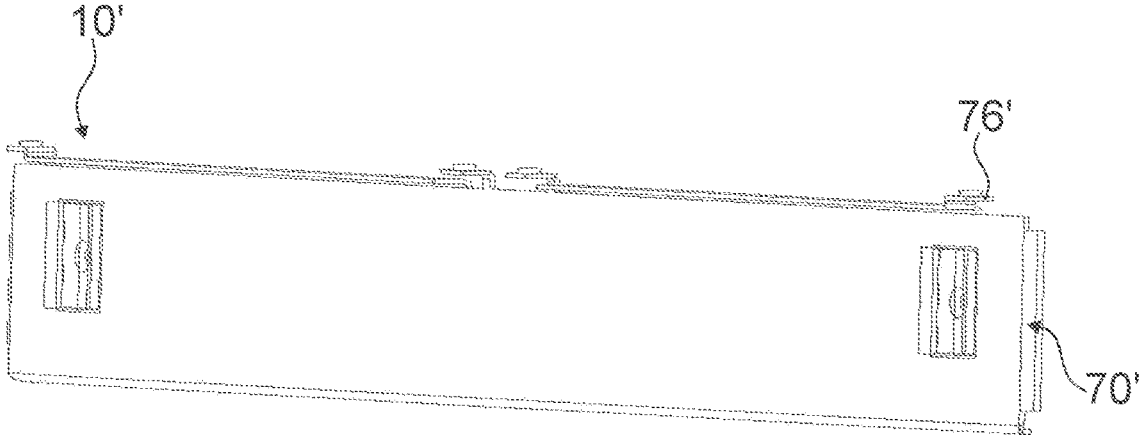
Figure 24A:
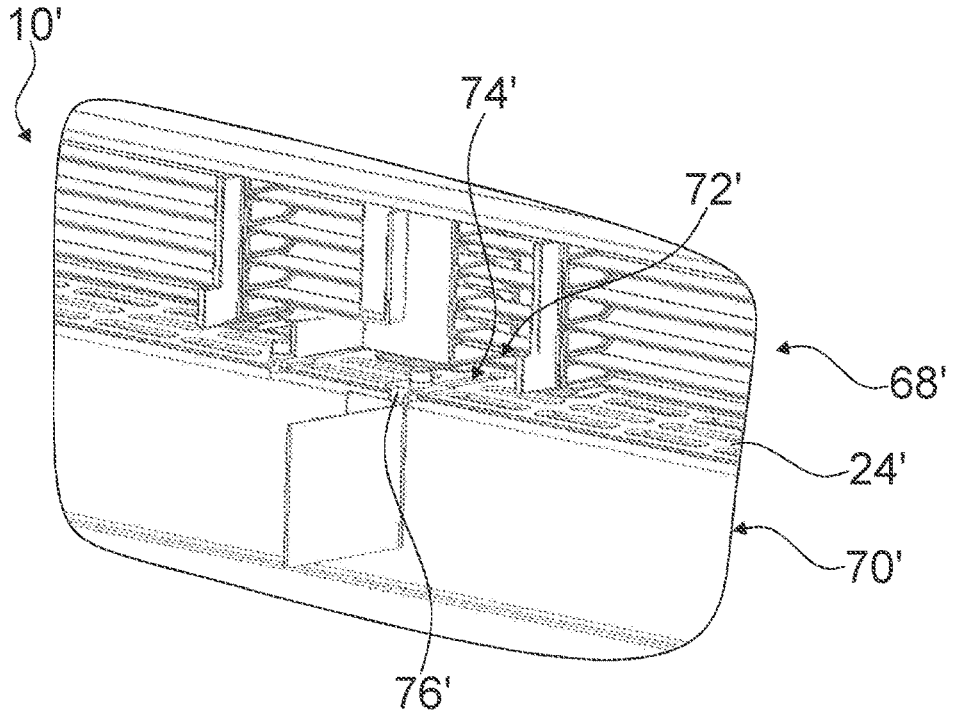
Figure 24B:
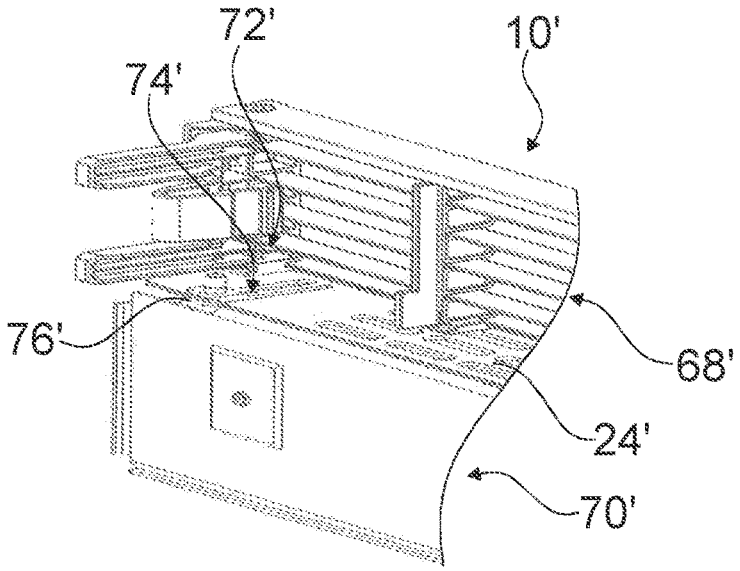

The panel 10' comprises a second panel module 200*b*' (see FIGS. 18A, 18B and 22). The panel module 200*b*' comprises a cover element 58*b*'. In the present case the cover element 58*b*' is a cover element for the water filter 106. The cover element 58*b*' at least partly, preferably entirely, covers the water filter 106. In the present case the cover element 58*b*' embodies the panel module 200*b* entirely. Further, the cover element 58*b*' embodies at least partly the panel module 200*a*' and at least partly a panel module 200*b*' of the panel 10'. The cover element 58*b*' is implemented integrally with a first fin mounting element 34*a*' of the panel module 200*a*'. The cover element 58*b*' is implemented integrally with a second fin mounting element 36*c*' of the panel module 200*c*' of the panel 10'.

The panel 10' comprises a third panel module 200*c*' (see FIGS. 18A and 18B). The third panel module 200*c*' differs from the aforementioned implementation of the first panel module 200*a*' at least substantially by its implementation of the fins 32*c*'. In the present case, the fins 32*c*' are shorter than the fin 32*a*'. Further the fin 32*c*' does not comprise a blocking recess. Due to the fact that the at least one fin 32 *c*' is shorter, fin reinforcement elements can be dispensed with as well. The panel module 200*c*' comprises at least one first fin mounting element 34*c*'. The panel module 200*c*' comprises at least one second fin mounting element 36*c*'. One of interconnection elements 110' is fixed to the first fin mounting element 34*c*' of the panel module 200*c'*.

The panel 10' comprises a first panel plane 68' (see FIGS. 18A, 18B, 23, 24A and 24B). The first panel plane 68' is embodied at least partly by at least one of the panel modules 200*a*', 200*b*', 200*c*'. In the present case the first panel plane 68' is embodied by the panel modules 200*a*', 200*b*', 200*c*'. The first panel plane 68' is further embodied at least partly by the connection unit 18, in particular by the connection element 22', the further connection element 24' and the additional connection element 26'. The panel 10' comprises a second panel plane 70'. The second panel plane 70' is embodied by a plate, in particular a metal plate of the panel 10'. The first panel plane 68' is positioned offset with respect to the second panel plane 70'.

The connection unit 18, in particular the further connection element 24', comprises at least one adjustment unit 72'. The adjustment unit 72' is configured for adjusting the offset of the first panel plane 68' with respect to the second panel plane 70'. The adjustment unit 72' comprises at least one adjustment element 74'. In the present case the adjustment unit 72' comprises four adjustment elements 74'. The adjustment elements 74' are embodied as slots. The adjustment unit 72' comprises at least one engagement element 76'. In the present case the adjustment unit comprises four engagement elements 76'. The engagement elements 76' correspond to the adjustment elements 74'. The engagement elements 76' are embodied by the second panel plane 70'. The engagement elements 76' are connected to the adjustment elements 72' by means of a screw connection.

The following is a summary list of reference numerals and the corresponding structure used in the above description of the invention:

10 Panel
14 Opening
16 Machine compartment
18 Connection unit
22 Connection element
24 Further Connection element
26 Connection element
32 Fin
34 First fin mounting element
36 Second fin mounting element
38 Lengthwise direction
40 Guiding element
42 Guiding element
44 Guiding element
50 Corresponding guiding element
52 Further corresponding guiding element
54 Fin reinforcement element
56 Air separator
58 Cover element
59 Cover element
62 Release element
68 Panel plane
70 Panel plane

72 Adjustment unit
74 Adjustment element
76 Engagement element
78 Home appliance
80 Housing
84 Storage compartment
88 Home appliance door
90 Refrigerant cycle
92 Compressor
94 Condenser
96 Dryer
98 Expansion device
100 Evaporator
102 Heat exchanger
104 Door opening unit
106 Water filter
108 Fan unit
110 Interconnection element
112 Further Interconnection element
114 Interconnection guiding element
116 Snap element
118 Corresponding interconnection element
120 Corresponding interconnection guiding element
122 Corresponding snap element
124 Deformation element
126 Further snap element
128 Further corresponding interconnection element
130 Further corresponding snap element
132 Angular deflection
134 Connection recess
136 Fixing edge
138 Blocking recess
140 Mounting profile
142 Corresponding angular deflection
144 Corresponding fixing edge
146 Connection hole
148 Connection pin
149 Connection pin
150 Reinforcement profile
152 Fixing protrusion
154 Corresponding angular deflection
156 Corresponding fixing edge
158 Corresponding guiding element
160 Further corresponding guiding element
162 Protrusion element
164 Protrusion recess
166 Separation profile
168 Corresponding angular deflection
170 Corresponding fixing edge
172 Corresponding guiding element
174 Further corresponding guiding element
176 Corresponding guiding element
178 Further corresponding guiding element
180 Hinge
182 Connection hole
200 Panel module
202 Screw
204 Screw
206 Screw
208 Screw
210 Screw
212 Screw

The invention claimed is:

1. A home appliance device comprising:

at least one panel for at least partly covering an opening of a machine compartment; and a connection unit for connecting the panel; the panel comprising at least one panel module which has at least one fin, at least one first fin mounting element and at least one second fin mounting element for mounting the at least one fin, the connection unit comprising at least one connection element extending in a direction parallel to a lengthwise direction of the at least one panel for connecting the at least one panel module, and wherein the connection element is movable with respect to the first fin mounting element and the second fin mounting element in the lengthwise direction of the panel in at least one pre-assembled state of the panel.

2. The home appliance device according to claim 1, the connection element having at least one guiding element; the first fin mounting element and the second fin mounting element each comprising at least one corresponding guiding element respectively cooperating with the guiding element of the connection unit at least in an assembled state.

3. The home appliance device according to claim 1, the panel module comprising at least one fin reinforcement element, which reinforces the fin at least in a direction that is perpendicular to the lengthwise direction and is connected to at least one of the fin mounting elements by means of the connection unit.

4. The home appliance device according to claim 1, the panel module comprising at least one air separator, which separates an air flow through the panel and is connected to at least one of the fin mounting elements by means of the connection unit.

5. The home appliance device according to claim 1, the panel comprising at least one cover element, which at least partly covers a machine component and which is connected to at least one of the fin mounting elements by means of the connection unit.

6. The home appliance device according to claim 5, the cover element at least partly embodying the panel module.

7. The home appliance device according to claim 5, the cover element being at least partly implemented integrally with at least one fin mounting element.

8. The home appliance device according to claim 1, further comprising at least one further panel module, which is connected to the panel module by means of the connection unit.

9. The home appliance device according to claim 8, the panel comprising at least one cover element, which covers at least partly a machine component and which embodies at least partly the panel module and at least partly the further panel module.

10. A home appliance device according to claim 1, wherein the connection unit is configured for interconnecting the panel toollessly with a housing of the home appliance device in a form-fit and/or force-fit manner, the connection unit having a release element, which is accessible through the panel and via which a connection of the panel and the housing is releasable.

11. A home appliance device according to claim 10, wherein the panel has a first panel plane and a second panel plane, which are connected to each other by means of the connection unit.

12. The home appliance device according to claim 11, the connection unit comprising an adjustment unit for adjusting an offset between the first panel plane and the second panel plane.

13. A home appliance device according to claim 10, wherein the at least one panel comprises at least two or a plurality of panel modules which have at least one or at least two or a plurality of fin/s, at least one first fin mounting element and at least one second fin mounting element for mounting at least one or at least two or a plurality of fin/s, the connection unit comprising at least one connection element for connecting the at least two panel modules to each other.

14. A home appliance comprising at least one home appliance device according to claim 10.

15. A method for assembling a home appliance device-according to claim 10, comprising at least one pre-assembly step, wherein at least one connection element is moved with respect to at least one first fin mounting element and at least one second fin mounting element in a lengthwise direction of the panel for connecting the panel.

16. A home appliance device according to claim 1, wherein the panel has a first panel plane and a second panel plane, which are connected to each other by means of the connection unit.

17. The home appliance device according to claim 16, the connection unit comprising an adjustment unit for adjusting an offset between the first panel plane and the second panel plane.

18. A home appliance device according to claim 1, wherein the at least one panel has at least two or a plurality of panel modules which have at least one or at least two or a plurality of fin/s, at least one first fin mounting element and at least one second fin mounting element for mounting at least one or at least two or a plurality of fin/s, the connection unit comprising at least one connection element for connecting the at least two panel modules to each other.

19. A home appliance comprising at least one home appliance device according to claim 1.

20. A method for assembling a home appliance device-according to claim 1, comprising at least one pre-assembly step, wherein at least one connection element is moved with respect to at least one first fin mounting element and at least one second fin mounting element in a lengthwise direction of the panel for connecting the panel.

* * * * *